US008358958B2

(12) United States Patent
Ito et al.

(10) Patent No.: US 8,358,958 B2
(45) Date of Patent: Jan. 22, 2013

(54) IMAGE FORMING APPARATUS PROVIDED WITH A PLURALITY OF IMAGE CARRIERS

(75) Inventors: Tetsushi Ito, Osaka (JP); Norio Tomita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 278 days.

(21) Appl. No.: 12/813,587

(22) Filed: Jun. 11, 2010

(65) Prior Publication Data

US 2010/0316396 A1 Dec. 16, 2010

(30) Foreign Application Priority Data

Jun. 15, 2009 (JP) ..... 2009-142447

(51) Int. Cl.
*G03G 15/01* (2006.01)

(52) U.S. Cl. ..... 399/301

(58) Field of Classification Search ..... 399/38, 399/43, 297–302, 308
See application file for complete search history.

(56) References Cited

U.S. PATENT DOCUMENTS 6,937,836 B2 * 8/2005 Wasai ..... 399/301
7,373,097 B2 5/2008 Ehara
7,826,755 B2 * 11/2010 Naoi et al. ..... 399/43
2006/0039722 A1 2/2006 Ehara

FOREIGN PATENT DOCUMENTS

| | | |
|---|---|---|
| JP | 2006-058415 | 3/2006 |
| JP | 2006-084669 | 3/2006 |
| JP | 2006-189660 | 7/2006 |
| JP | 2006-208630 | 8/2006 |
| JP | 2006-293294 | 10/2006 |
| JP | 2009-122392 | 6/2009 |

* cited by examiner

*Primary Examiner* — Hoan Tran
(74) *Attorney, Agent, or Firm* — Renner, Otto, Boisselle & Sklar, LLP

(57) ABSTRACT

In one embodiment, the present invention provides an image forming apparatus that forms a plurality of images using a plurality of image carriers respectively corresponding to the images and stacks those images, the apparatus having a first group to which at least one image carrier among the plurality of image carriers belongs, a second group to which at least one image carrier among the remaining image carriers belongs, and a single detection sensor that detects a first detection information for identifying a rotation timing of the first group image carrier and also detects a second detection information for identifying a rotation timing of the second group image carrier.

31 Claims, 11 Drawing Sheets

100a
140a
140(140b)
130
130a
131
131a
131b
131c
131d
141
141a
141b
141c
141d
170
171
171a
171b
172
173
173a
173b
174
174a
175
175a
180
101
101a
101b
A1
A2
X
Y1
Y2
R1
R2
r1
r2
θ1
θ2
φ1
φ2
α1
α1x
α1y
α2
α2x
α2y
β1
β2

100c
140a
140y
130a
130y
130x
170y
171
171a
171b
172a
172y
173c
173y
174a
174y
175a
175y
101
101a
101by
131
131a
131b
131c
131d
141
141a
141b
141c
141d
R1
R2
X
Y1
Y2
A1
A2

IMAGE FORMING APPARATUS PROVIDED WITH A PLURALITY OF IMAGE CARRIERS

BACKGROUND OF THE INVENTION

This application claims priority under 35 U.S.C. §119(a) on Patent Application No. 2009-142447 filed in Japan on Jun. 15, 2009, the entire contents of which are herein incorporated by reference.

The present invention relates to an image forming apparatus provided with a plurality of image carriers.

As an image forming apparatus, a so-called tandem image forming apparatus is conventionally known in which a plurality of images (for example, toner images) are formed by an image forming process of an electrophotographic method or the like, using a plurality of image carriers such as photosensitive bodies or the like that respectively correspond to the images, and the images are overlaid together. For example, when forming a full-color image, toner images of a plurality of mutually differing colors (ordinarily, color components of each of yellow (Y), magenta (M), cyan (C), and black (K)) are formed at a coordinated timing on the plurality of image carriers corresponding to the respective toner images, the respective toner images are transferred in a stacked manner to a transfer-receiving body such as an intermediate transfer body or a recording material, and when the transfer-receiving body is an intermediate transfer body, the toner images are furthermore transferred to a recording material.

In this conventional image forming apparatus, in some cases a first group to which at least one image carrier among the plurality of image carriers belongs, and a second group to which at least one image carrier among the remaining image carriers belongs, are driven independently.

Specifically, when monochrome image forming is performed, ordinarily a black image is formed individually without forming an image of another color. In this case, an image carrier corresponding to black and an image forming member (a member including a black development apparatus) for forming an image on the image carrier are driven with a different drive unit, such as a motor, than a plurality of image carriers respectively corresponding to other images (yellow, magenta, and cyan images) and image forming members (members including yellow, magenta, and cyan development apparatuses) for forming images on the image carriers.

On the other hand, although it is necessary to drive image carriers and image forming members for images in colors other than black (yellow, magenta, and cyan images), in order to reduce the number of drive components to achieve a smaller size for the image forming apparatus, it is possible to drive the respective image carriers for yellow, magenta, and cyan, which are driven simultaneously, and the image forming members corresponding to the image carriers, with a single drive unit. With such a configuration it is possible to reduce the number of components. A stepper motor is an example of a drive unit that drives a plurality of image carriers and image forming members.

Incidentally, even when a plurality of images are formed at a coordinated timing on the plurality of image carriers, image shift may occur when stacking the images of the respective image carriers. In order to prevent such image shift from occurring, it is important to precisely stack the images of the respective image carriers.

The occurrence of image shift is caused by, for example, rotational irregularity phase shift due to, for example, image carrier eccentricity, eccentricity of a drive transmission rotation member such as a drive gear that transmits rotational drive to an image carrier from a drive unit, and so forth.

For example, when a first group image carrier and a second group image carrier are driven independently, ordinarily, at the time of initial driving such as when power is turned on and at each instance of a predetermined period, the rotation phase of the first group image carrier and the second group image carrier are adjusted to a reference rotation phase, which is an optimal rotation phase where the rotational irregularity phase shift is as small as possible. However, even if phase matching is performed such that the rotation phase of the first group image carrier and the second group image carrier becomes the reference rotation phase, when an image is formed by driving only any one among the first group image carrier and the second group image carrier, in some instances the rotation phase of the first group image carrier and the second group image carrier may be completely different from the reference rotation phase. Alternatively, there may be instances when the rotation phase of the first group image carrier and the second group image carrier is shifted from the reference rotation phase, and thus image shift (phase shift) occurs.

In order to correct the rotation phase of the first group image carrier and the second group image carrier so as to become the reference rotation phase, conventionally, a detection sensor that performs phase matching of the rotation phase of the plurality of images that are stacked (that is, the plurality of image carriers) is provided for each image carrier, a rotation phase is detected by each of these detection sensors, a rotation phase difference of the detected rotation phase relative to the reference rotation phase is detected, and by thus changing at least one among the rotation timing of the first group image carrier and the rotation timing of the second group image carrier to correct the rotation phase of the first group image carrier and the second group image carrier, phase matching is performed. In this way it is possible to reduce the occurrence of rotational irregularity phase shift caused by eccentricity or the like.

Specifically, a detection sensor is provided for a first gear that transmits rotational drive to a first group image carrier (for example, a group carrier to which the black image carrier belongs), and a second gear that transmits rotational drive to a second group image carrier (for example, a group carrier to which the yellow, magenta, and cyan image carriers belong), the detection sensor detecting the rotational phase of the corresponding gear. Phase matching is determined by detecting the rotation phase of the first group image carrier and the second group image carrier with the respective detection sensors.

For example, JP 2006-84669A discloses a color image forming apparatus in which a photosensitive body is driven by a DC brushless motor having a Hall element via a drum gear provided with a rotation phase detection sensor, and rotation phase is detected in the drum gear and the motor.

However, at least one detection sensor that performs phase matching from the rotational irregularity of each image carrier is necessary for each image carrier that is driven. That is, for example, when a first group image carrier and a second group image carrier are independently driven, at least two sensors are necessary. Therefore, to that extent the apparatus configuration becomes more complex, and cost of the apparatus increases.

SUMMARY OF THE INVENTION

The present invention aims to provide an image forming apparatus that forms a plurality of images using a plurality of image carriers respectively corresponding to the images and stacks those images, wherein a number of detection sensors that perform phase matching from rotational irregularity of the respective image carriers can be as small as possible, and thus simplified apparatus configuration and decreased cost can be realized.

In order to achieve the above aims, the present invention provides an image forming apparatus that forms a plurality of images using a plurality of image carriers respectively corresponding to the images and stacks those images, the apparatus having a first group to which at least one image carrier among the plurality of image carriers belongs, a second group to which at least one image carrier among the remaining image carriers belongs, and a single detection sensor that detects a first detection information for identifying a rotation timing of the first group image carrier and also detects a second detection information for identifying a rotation timing of the second group image carrier.

According to the present invention, the first detection information is detected and the second detection information is detected by the single detection sensor. Therefore, it is possible to detect the rotation phase of the first group image carrier and the second group image carrier while the number of detection sensors that perform phase matching from rotational irregularity of the first group image carrier and the second group image carrier is as small as possible, and thus simplified apparatus configuration and decreased cost can be realized.

Here, "the rotation phase of the first group image carrier and the second group image carrier" is a concept indicating the relative positions of the rotation position of the first group image carrier and the rotation position of the second group image carrier, and can be expressed as a rotation angle or corresponding time and distance, or the like.

In the present invention, it is preferable that the first detection information and the second detection information are caused to differ from each other, such that a difference between the rotation timing of the first group image carrier and the rotation timing of the second group image carrier can be identified with the single detection sensor.

According to this specific aspect of the invention, it is possible to easily identify a difference between the first detection information and the second detection information, and accordingly, it is possible to identify which group image carrier among the first group image carrier and the second group image carrier whose rotation position should be changed (for example, which group image carrier whose speed should be increased, or should be decreased).

In the present invention, in an example mode, the first detection information includes information of a first rotation angle of the first group image carrier, and the second detection information includes information of a second rotation angle of the second group image carrier.

Here, "rotation angle" means an angle formed by a straight line from a center of rotation to the position of a detection start point, and a straight line from the center of rotation to the position of a detection end point.

According to this specific aspect of the invention, it is possible to detect the rotation phase of the first group image carrier and the second group image carrier with a single detection sensor in a simple configuration.

For example, in an example mode, the first rotation angle differs from the second rotation angle.

According to this specific aspect of the invention, it is possible to easily identify a difference between the first detection information and the second detection information.

Also, in an example mode, the first detection information includes a first displacement information of a detection subject according to rotation of the first group image carrier relative to the detection sensor, and the second detection information includes a second displacement information of a detection subject according to rotation of the second group image carrier relative to the detection sensor. In this case, it is preferable that the first displacement information differs from the second displacement information. In this case as well, it is possible to easily identify a difference between the first detection information and the second detection information.

In an example mode, the present invention is provided with a first drive unit for driving the first group image carrier, a second drive unit for driving the second group image carrier, a first rotation member that rotates according to rotation of the first group image carrier by the first drive unit, and a second rotation member that rotates according to rotation of the second group image carrier by the second drive unit, the detection sensor detecting detection information of rotation timing of the first rotation member as the first detection information, and also detecting detection information of rotation timing of the second rotation member as the second detection information.

By way of example, the first rotation member is a first drive transmission rotation member such as a gear that transmits rotational drive from the first drive unit to the first group image carrier. By way of example, the second rotation member is a second drive transmission rotation member such as a gear that transmits rotational drive from the second drive unit to the second group image carrier.

By way of example, the first rotation member and the second rotation member can otherwise be a flange of the image carriers, a preexisting member such as a coupling member that links the image carrier to a drive transmission system that transmits power from the drive unit to the image carrier, or an additional member such as a disc separately provided in the drive transmission system.

In one mode of the present invention, the first rotation member includes a first gear that transmits drive from the first drive unit to the first group image carrier; the second rotation member includes a second gear that transmits drive from the second drive unit to the second group image carrier, and whose rotational axis line is parallel to the first gear; the detection sensor has an actuator unit capable of moving back-and-forth in the rotational axis line direction, a detected portion provided in the actuator unit, and a sensor unit that detects the detected portion; a first opposing portion that opposes a side face of the first gear and a second opposing portion that opposes a side face of the second gear are provided in the actuator unit; a first cam unit (for example, a first cam unit constituted from a first convex portion or a first concave portion) is provided in a portion in the circumferential direction of the first opposing region that opposes the first opposing portion of the side face of the first gear; a second cam unit (for example, a second cam unit constituted from a second convex portion or a second concave portion) is provided in a portion in the circumferential direction of the second opposing region that opposes the second opposing portion of the side face of the second gear; the first opposing portion and the first cam unit are formed such that the sensor unit detects the first detection information from back-and-forth movement of the detected portion according to back-and-forth movement in the rotational axis line direction of the actuator unit; and the second opposing portion and the second cam unit are formed such that the sensor unit detects the second detection information from back-and-forth movement of the detected portion according to back-and-forth movement in the rotational axis line direction of the actuator unit.

According to this specific aspect of the invention, by detecting information of the first rotation angle as the first detection information of the first rotation member, and detecting information of the second rotation angle as the second detection information of the second rotation member, it is possible to easily detect the rotation phase of the first group image carrier and the second group image carrier with the single detection sensor.

In the present invention, the following can be given as example modes in which the first detection information differs from the second detection information.

In mode (a), a rotation angle of an arc-like detection region formed along the first opposing region of the first cam unit differs from a rotation angle of an arc-like detection region formed along the second opposing region of the second cam unit.

In this mode, it is preferable that a first center angle of the arc-like detection region formed along the first opposing region opposing the first opposing portion in the actuator unit is the same as a second center angle of the arc-like detection region formed along the second opposing region opposing the second opposing portion in the actuator unit.

In mode (b), a first center angle of an arc-like detection region formed along the first opposing region opposing the first opposing portion in the actuator unit differs from a second center angle of an arc-like detection region formed along the second opposing region opposing the second opposing portion in the actuator unit.

In this mode of the invention, it is preferable that a rotation angle of an arc-like detection region formed along the first opposing region of the first cam unit is the same as a rotation angle of an arc-like detection region formed along the second opposing region of the second cam unit.

Here, "the arc-like detection region formed in the first cam unit" and "the arc-like detection region formed in the first opposing portion in the actuator unit" refer to a region for detecting the first detection information with the detection sensor, and "the arc-like detection region formed in the second cam unit" and "the arc-like detection region formed in the second opposing portion in the actuator unit" refer to a region for detecting the second detection information with the detection sensor.

In above modes (a) and (b), as the sensor unit, it is possible to use a light sensor that is provided with a light-emitting portion and a light-receiving portion, and by blocking or allowing passage of incident light that is incident on the light-receiving portion from the light-emitting portion at the detected portion by back-and-forth movement of the detected portion according to back-and-forth movement of the actuator unit in the rotational axis line direction, detects the presence of the incident light at the light-receiving portion.

In mode (c), using a detected position of the detected portion or a detection position of the sensor unit as a reference, a detected portion-side first relative distance in the rotational axis line direction from a first detection position of the first cam unit differs from a detected portion-side second relative distance in the rotational axis line direction from a second detection position of the second cam unit.

In this mode, it is preferable that, using the detected position of the detected portion or the detection position of the sensor unit as a reference, an actuator unit-side first relative distance in the rotational axis line direction from a first detection position of the first opposing portion equals an actuator unit-side second relative distance in the rotational axis line direction from a second detection position of the second opposing portion.

In mode (d), using a detected position of the detected portion or a detection position of the sensor unit as a reference, an actuator unit-side first relative distance in the rotational axis line direction from a first detection position of the first opposing portion differs from an actuator unit-side second relative distance in the rotational axis line direction from a second detection position of the second opposing portion.

In this mode, it is preferable that, using the detected position of the detected portion or the detection position of the sensor unit as a reference, a detected portion-side first relative distance in the rotational axis line direction from a first detection position of the first cam unit equals a detected portion-side second relative distance in the rotational axis line direction from a second detection position of the second cam unit.

Here, "a first detection position of the first cam unit" and "a first detection position of the first opposing portion" refer to a position for detecting the first detection information with the detection sensor, and "a second detection position of the second cam unit" and "a second detection position of the second opposing portion" refer to a position for detecting the second detection information with the detection sensor.

In above modes (c) and (d), a displacement sensor that detects the distance to the detected position of the detected portion can be used as the sensor unit.

In above modes (a) to (d), it is possible to easily identify a difference between the first detection information and the second detection information.

In the present invention, the size of the first opposing region in the side face of the first gear and the size of the second opposing region in the side face of the second gear may be the same, or different.

Incidentally, in order to reduce as much as possible rotational irregularity phase shift caused by eccentricity or the like, in consideration of easily matching the rotational irregularity cycles of the respective group image carriers, it is preferable that the first gear and the second gear share components.

However, when the size of the first opposing region equals the size of the second opposing region, particularly in above mode (a), because the rotation angles of the arc-like detection regions differ from each other, it is not possible to share components between the first gear and the second gear. Therefore, in a mode in which the size of the first opposing region differs from the size of the second opposing region, it is preferable that in the first gear, in addition to the first cam unit, the second cam unit provided in the second gear is provided when the first gear serves as the second gear, and in the second gear, in addition to the second cam unit, the first cam unit provided in the first gear is provided when the second gear serves as the first gear. According to this mode, it is possible to share components between the first gear and the second gear, and thus, it becomes easier to match the rotational irregularity cycles of the respective group image carriers, and component cost can be kept down.

In the present invention it is preferable that the first cam unit and the second cam unit have an ascending slope portion and a descending slope portion.

According to this specific aspect of the invention, it is possible to cause the first opposing portion and the second opposing portion to smoothly slide relative to the first cam unit and the second cam unit, and thus, it is possible to suppress shock to the first group image carrier and the second group image carrier, and to that extent it is possible to obtain a better image.

In the present invention a configuration may be adopted in which, among both ends along the first opposing region in the first opposing portion, a corner of at least one end has the form of a curved face, and among both ends along the second opposing region in the second opposing portion, a corner of at least one end has the form of a curved face. Instead, the first opposing portion and the second opposing portion may have an ascending slope portion and a descending slope portion.

According to this specific aspect of the invention, it is possible to cause the first cam unit and the second cam unit to smoothly slide relative to the first opposing portion and the second opposing portion, and thus, it is possible to suppress shock to the first group image carrier and the second group image carrier, and to that extent it is possible to obtain a better image.

In the present invention, between the ascending slope portion and the descending slope portion may be a flat portion that is orthogonal to the rotational axis line direction.

According to this specific aspect of the invention, it is possible to insure a state of detection or non-detection by the detection sensor in the flat portion and to that extent it is possible to more stably detect the first detection information and the second detection information.

Here, as an ordinary gear, from the viewpoint of maintaining strength while lightening the gear, often a rib is provided in a side face of the gear. In consideration of such a gear, the first cam unit may be formed in a rib provided in a side face of the first gear (for example, a rib along the first opposing region). Also, the second cam unit may be formed in a rib provided in a side face of the second gear (for example, a rib along the second opposing region).

According to this specific aspect of the invention, a configuration of the present invention is easily applicable to a gear having a rib, as in the conventional technology.

In the present invention, the actuator unit may be energized toward the first gear and the second gear by the weight of the actuator unit, but an energizing member that energizes the actuator unit toward the first gear and the second gear is preferably provided.

According to this specific aspect of the invention, with the energizing member it is possible to cause the first opposing portion and the second opposing portion, and the first cam unit and the second cam unit, to slide reliably, and to that extent it is possible to more stably detect the first detection information and the second detection information with the detection sensor.

In an example mode, the present invention is provided with a phase adjustment unit that adjusts a rotation phase of the first group image carrier and the second group image carrier to a reference rotation phase serving as a reference; a phase detection unit that detects the rotation phase of the first group image carrier and the second group image carrier based on the first detection information and the second detection information by the detection sensor; a phase difference detection unit that detects a rotation phase difference of the rotation phase detected by the phase detection unit relative to the reference rotation phase adjusted by the phase adjustment unit; and a rotation phase correction unit that, based on the detection result by the phase difference detection unit, changes at least one among the rotation timing of the first group image carrier and the rotation timing of the second group image carrier to correct the rotation phase of the first group image carrier and the second group image carrier.

According to this specific aspect of the invention, first, with the phase adjustment unit, the rotation phase of the first group image carrier and the second group image carrier is adjusted to the reference rotation phase.

Afterward, because the rotation phase of the first group image carrier and the second group image carrier may be shifted from the reference rotation phase, with the phase detection unit, the rotation phase of the first group image carrier and the second group image carrier is detected based on the first detection information and the second detection information by the detection sensor, with the phase difference detection unit, a rotation phase difference of the rotation phase detected by the phase detection unit from the reference rotation phase adjusted by the phase adjustment unit is detected, and with the rotation phase correction unit, based on the detection result by the phase difference detection unit, at least one among the rotation timing of the first group image carrier and the rotation timing of the second group image carrier is changed to correct the rotation phase of the first group image carrier and the second group image carrier. Thus, it is possible to match the rotation phase of the first group image carrier and the second group image carrier to the reference rotation phase, and thus, it is possible to reduce rotational irregularity phase shift (image shift) caused by eccentricity or the like.

In the present invention, a configuration may also be adopted in which the first detection information and the second detection information detected with the single detection sensor are the same. Thus, the subject of detection according to rotation of the first group image carrier relative to the detection sensor and the subject of detection according to rotation of the second group image carrier relative to the detection sensor can be easily shared. However, in this case, because the first detection information and the second detection information detected with the single detection sensor are the same, with only these pieces of information, it is not possible to identify a difference between the rotation timing of the first group image carrier and the rotation timing of the second group image carrier. In other words, with only the first detection information and the second detection information, it is not possible to identify which group image carrier among the first group image carrier and the second group image carrier whose rotation position should be changed (for example, which group image carrier whose speed should be increased, or should be decreased).

In this case, it is possible to change the rotation position of at least one group image carrier among the first group image carrier and the second group image carrier (for example, increasing or decreasing the speed of either group image carrier), and further provide a confirmation means that confirms whether or not the rotation phase is separated from the reference rotation phase. A configuration can be adopted in which, in the phase adjustment unit and the rotation phase correction unit, when changing the rotation position of at least one group image carrier among the first group image carrier and the second group image carrier, after confirming whether or not the rotation phase is separated from the reference rotation phase with the confirmation means, when the rotation phase is separated from the reference rotation phase, the change in the rotation position of at least one group image carrier is reversed (for example, when the speed of either group image carrier was increased, that speed is decreased, or when the speed of either group image carrier was decreased, that speed is increased). Note that in this case, it is likely to take time to detect the rotation phase, and the control configuration is made more complicated.

From this viewpoint, as previously described, it is preferable that the first detection information and the second detection information are caused to differ from each other, such that a difference between the rotation timing of the first group image carrier and the rotation timing of the second group image carrier can be identified by the single detection sensor.

By adopting such a configuration, it is possible to identify which group image carrier among the first group image carrier and the second group image carrier whose rotation position should be changed (for example, which group image carrier whose speed should be increased, or should be decreased), and thus, it does not take time needed to confirm whether or not the rotation phase is separated from the reference rotation phase, and moreover the control configuration is not made more complicated.

In the present invention, in an example mode, the phase detection unit measures a phase time between a detection start of the first detection information by the detection sensor and a detection start of the second detection information by the detection sensor, or measures a phase time between a detection end of the first detection information by the detection sensor and a detection end of the second detection information by the detection sensor.

According to this specific aspect of the invention, it is possible to detect the rotation phase of the first group image carrier and the second group image carrier with a simple control configuration.

Incidentally, as in a case in which only any one among the first group image carrier and the second group image carrier is driven and so the rotation phase of the first group image carrier and the second group image carrier is completely different from the reference rotation phase, depending on the rotation position of the first group image carrier and the second group image carrier, in some instances the first detection time and part of the second detection time may overlap, or alternatively, all of any one among the first detection time and the second detection time may overlap with part of the other detection time. Thus, the detection start and the detection end by the detection sensor only exist in one location.

From this viewpoint, it is preferable that in the phase detection unit, when the detection start by the detection sensor only exists in one location, at least one among the first group image carrier and the second group image carrier is rotated such that the detection start by the detection sensor exists in two locations, and then the phase time is measured, or, when the detection end by the detection sensor only exists in one location, at least one among the first group image carrier and the second group image carrier is rotated such that the detection end by the detection sensor exists in two locations, and then the phase time is measured.

According to this specific aspect of the invention, it is possible to reliably detect the rotation phase of the first group image carrier and the second group image carrier.

In the present invention, it is preferable that the reference rotation phase adjusted by the phase adjustment unit is stored in advance in the storage unit, and the phase difference detection unit detects a rotation phase difference of the rotation phase detected by the phase detection unit, relative to the reference rotation phase stored in the storage unit.

According to this specific aspect of the invention, for example, if the reference rotation phase is adjusted by the phase adjustment unit at the time of initial driving and/or at each instance of a predetermined period, and stored in the storage unit when performing the adjustment, it is possible to eliminate a wasteful adjustment operation by the phase adjustment unit, and to that extent it is possible to shorten the operation control time.

In the present invention, it is preferable that the phase detection unit detects the rotation phase during a print operation.

According to this specific aspect of the invention, the rotation phase is detected during a print operation, so it is not necessary to separately drive the first group image carrier and the second group image carrier in order to detect the rotation phase, and to that extent it is possible to efficiently detect the rotation phase.

In the present invention, in an example mode, the first group image carrier is for performing monochrome image forming, and the second group image carrier is for performing full-color image forming in collaboration with the first group image carrier.

According to this specific aspect of the invention, it is possible for the image forming apparatus of the present invention to be a color image forming apparatus. That is, by the single detection sensor performing phase matching from rotational irregularity of the first group image carrier for performing monochrome image forming, and the second group image carrier for performing full-color image forming in collaboration with the first group image carrier, it is possible to reduce color shift due to phase shift, and thus it is possible to achieve a reduction in cost.

As described above, according to the image forming apparatus of the present invention, due to providing the single detection sensor that detects the first detection information and also detects the second detection information, the number of detection sensors that perform phase matching from rotational irregularity of the respective image carriers can be as small as possible, and thus simplified apparatus configuration and decreased cost can be realized.

DESCRIPTION OF PREFERRED EMBODIMENTS

Hereinafter, embodiments of the present invention are described in detail with reference to the accompanying drawings. The following embodiments are specific examples of the present invention, and are not of a nature limiting the technological scope of the present invention.

Figure 1:
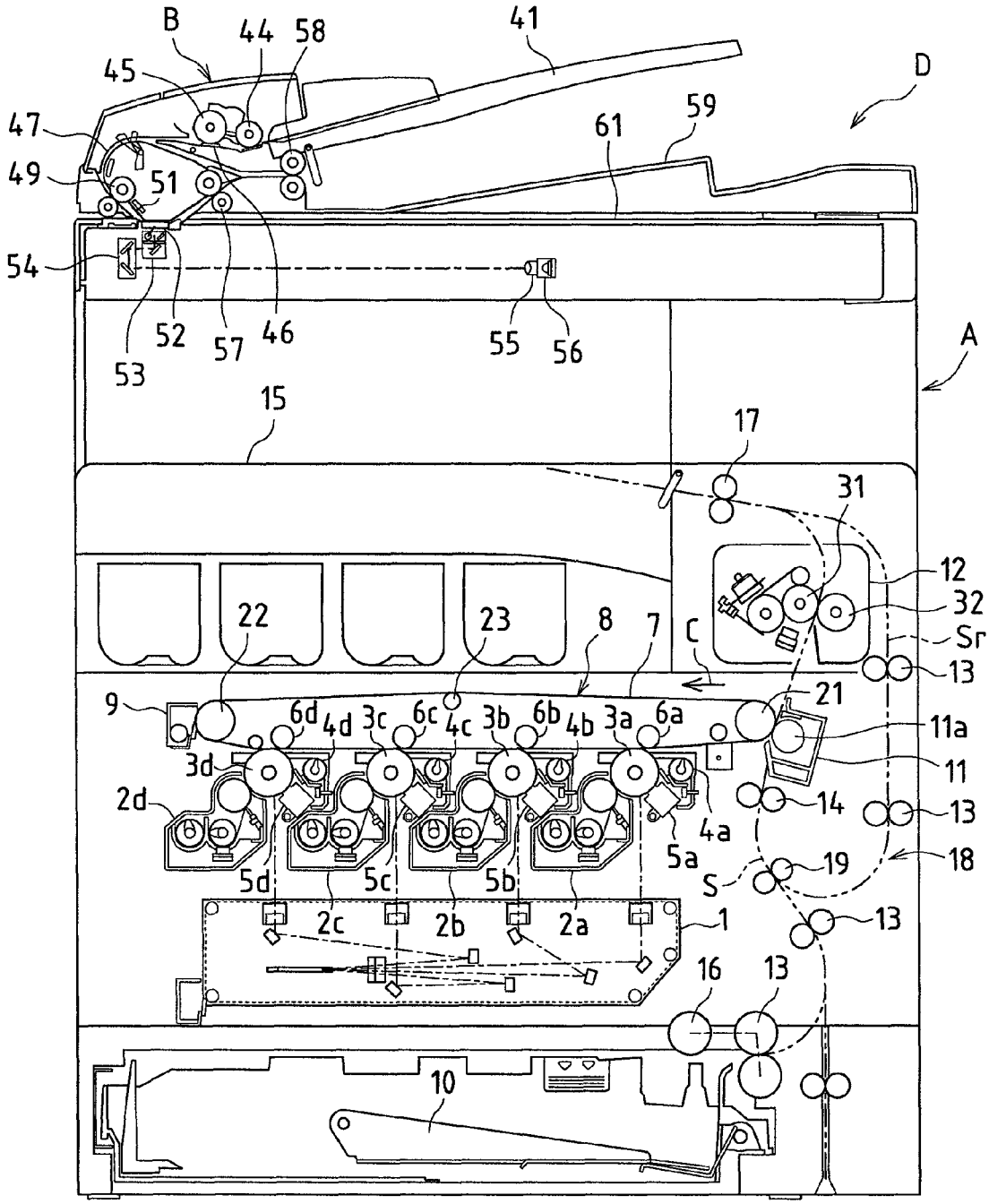
FIG. 1 is a side view that schematically shows a color image forming apparatus in accordance with an embodiment of the present invention.

FIG. 1 is a side view that schematically shows a color image forming apparatus D in accordance with an embodiment of the present invention.

The color image forming apparatus D is provided with an original reading apparatus B that reads an image of an original, and an apparatus main body A that records/forms the original image read by the original reading apparatus B or an image received from outside on a recording material such as standard paper, as a full color image or as a monochrome image.

In the original reading apparatus B, when an original is placed in an original placement tray 41, a pickup roller 44 is pressed against a surface of the original and rotated, and thus the original is drawn out from the tray 41, passes between a separation roller 45 and a separation pad 46 to be separated page-by-page, and then is transported to a transport path 47.

In the transport path 47, a leading edge of the original abuts against a registration roller 49 and is aligned parallel to the registration roller 49, and then the original is transported by the registration roller 49 and passes between an original guide 51 and a reading glass 52. At this time, the original surface is irradiated with light from a light source of a first scanning unit 53 via the reading glass 52, that reflected light is incident on the first scanning unit 53 via the reading glass 52, this reflected light is reflected by mirrors of the first scanning unit 53 and a second scanning unit 54 and guided to an imaging lens 55, and thus an image of the original surface is formed on a CCD (Charge Coupled Device) 56 by the imaging lens 55. The CCD 56 reads the image of the original surface and outputs image data expressing that image. Further, the original is transported by a transport roller 57, and discharged to a original discharge tray 59 via a discharge roller 58.

The original reading apparatus B is capable of reading an original that has been placed on an original stage glass 61. The registration roller 49, the original guide 51, the original discharge tray 59 and so forth, and a members on the upper side thereof, are a single integrated cover body, the cover body being axially supported on a back face side of the original reading apparatus B so as to be capable of opening/closing around an axial line in the original transport direction. When this cover body on the upper side is opened, the original stage glass 61 is released, and an original can be placed on the original stage glass 61. When the cover body is closed, the original placed on the original stage glass 61 is held by the cover body. When there is an original reading instruction, the original surface on the original stage glass 61 is exposed to light by the first scanning unit 53 while the first scanning unit 53 and the second scanning unit 54 are moved in a sub-scanning direction. Reflected light from the original surface is guided to the imaging lens 55 by the first scanning unit 53 and the second scanning unit 54, an image is formed on the CCD 56 by the imaging lens 55, and here an original image is read. At this time, the first scanning unit 53 and the second scanning unit 54 are moved while maintaining a predetermined speed relationship relative to each other, so that the positional relationship of the first scanning unit 53 and the second scanning unit 54 is always maintained such that the length of a light path of reflected light, specifically a light path of original surface→first scanning unit 53 and second scanning unit 54→imaging lens 55→CCD 56, does not change, and thus focus of the image of the original surface on the CCD 56 is always accurately maintained.

The entire original image that has been read in this way is sent to/received by the apparatus main body A of the color image forming apparatus D as image data, and in the apparatus main body A the image is recorded on recording material.

On the other hand, the apparatus main body A of the color image forming apparatus D forms a plurality of images using photosensitive drums 3 (3*a*, 3*b*, 3*c*, and 3*d*) that operate as a plurality of image carriers respectively corresponding to the images, and stacks those images. The apparatus main body A is provided with an exposure apparatus 1, development apparatuses 2 (2*a*, 2*b*, 2*c*, and 2*d*), the photosensitive drums 3 (3*a*, 3*b*, 3*c*, and 3*d*) disposed in a line in the recording material transport direction, charging units 5 (5*a*, 5*b*, 5*c*, and 5*d*), cleaning apparatuses 4 (4*a*, 4*b*, 4*c*, and 4*d*), an intermediate transfer belt apparatus 8 that includes intermediate transfer rollers 6 (6*a*, 6*b*, 6*c*, and 6*d*) that operate as a transfer unit, a fixing apparatus 12, a transport apparatus 18, a paper feed tray 10 that operates as a paper feed unit, and a discharge tray 15 that operates as a discharge unit.

Image data handled in the apparatus main body A of the color image forming apparatus D corresponds to a color image employing each of the colors black (K), cyan (C), magenta (M), and yellow (Y), or corresponds to a monochrome image employing a single color (for example, black). Accordingly, four each of the development apparatuses 2 (2*a*, 2*b*, 2*c*, and 2*d*), the photosensitive drums 3 (3*a*, 3*b*, 3*c*, and 3*d*), the charging units 5 (5*a*, 5*b*, 5*c*, and 5*d*), the cleaning apparatuses 4 (4*a*, 4*b*, 4*c*, and 4*d*), and the intermediate transfer rollers 6 (6*a*, 6*b*, 6*c*, and 6*d*) are provided such that four types of images corresponding to each color are formed. Among the four suffix letters a to d, a is associated with black, b is associated with cyan, c is associated with magenta, and d is associated with yellow. In this way, four image stations are configured. In the description below, the suffix letters a to d are omitted.

The photosensitive drum 3 is disposed in approximately the center in the vertical direction of the apparatus main body A. The charging unit 5 is a charging means for uniformly charging the surface of the photosensitive drum 3 to a predetermined potential, and a roller-type or a brush-type charging unit, which are contact-type charging units, or otherwise a charger-type charging unit, is used in the charging unit 5.

Here, the exposure apparatus 1 is a laser scanning unit (LSU) provided with a laser light source and a reflecting mirror, exposes the charged surface of the photosensitive drum 3 corresponding to the image data, and forms an electrostatic latent image corresponding to the image data on that surface.

The development apparatus 2 uses (K, C, M, Y) toner to develop the electrostatic latent image formed on the photosensitive drum 3. The cleaning apparatus 4 removes and recovers toner remaining on the surface of the photosensitive drum 3 after development and image transfer.

The intermediate transfer belt apparatus 8 disposed above the photosensitive drum 3, in addition to the intermediate transfer roller 6, is provided with an intermediate transfer belt 7 that operates as an intermediate transfer body, an intermediate transfer belt drive roller 21, a driven roller 22, a tension roller 23, and an intermediate transfer belt cleaning apparatus 9.

Roller members such as the intermediate transfer belt drive roller 21, the intermediate transfer roller 6, the driven roller 22, and the tension roller 23 support the intermediate transfer belt 7, which is stretched across those roller members, and the intermediate transfer belt 7 is moved around the roller members in a predetermined transport direction (the direction of arrow C in FIG. 1).

The intermediate transfer roller 6 is rotatably supported inside of the intermediate transfer belt 7, is pressed against the photosensitive drum 3 via the intermediate transfer belt 7, and a transfer bias for transferring a toner image of the photosensitive drum 3 to the intermediate transfer belt 7 is applied to the intermediate transfer roller 6.

The intermediate transfer belt 7 is provided so as to contact each photosensitive drum 3, and forms a color toner image (toner images of each color) by successively transferring in a stacked manner the toner image of the surface of each photosensitive drum 3 to the intermediate transfer belt 7. Here, the transfer belt 7 is formed as an endless belt using a film having a thickness of about 100 to 150 μm.

Transfer of a toner image from the photosensitive drum 3 to the intermediate transfer belt 7 is performed by the intermediate transfer roller 6, which is pressing against the inside (back face) of the intermediate transfer belt 7. A high voltage transfer bias (for example, a high voltage of opposite polarity (+) as the toner charging polarity (−)) is applied to the intermediate transfer roller 6 in order to transfer a toner image. Here, the intermediate transfer roller 6 is a roller having a metal (for example, stainless steel) shaft of diameter 8 to 10 mm as a base, with the surface of that shaft covered by a conductive elastic material (for example, such as EPDM or urethane foam). By using this conductive elastic material, a high voltage can be uniformly applied to the recording material.

The apparatus main body A of the color image forming apparatus

D is further provided with a secondary transfer apparatus 11 that includes a transfer roller 11*a* that operates as a transfer unit. The transfer roller 11*a* is in contact with the opposite side (outside) of the intermediate transfer belt 7 as the intermediate transfer belt drive roller 21.

As described above, the toner image on the surface of each photosensitive drum 3 is stacked on the intermediate transfer belt 7, and these toner images become the full-color toner image expressed by the image data. The toner images of each color stacked in this way are transported along with the intermediate transfer belt 7, and transferred onto the recording material by the secondary transfer apparatus 11.

The intermediate transfer belt 7 and the transfer roller 11*a* of the secondary transfer apparatus 11 press against each other, thereby forming a nip region. A voltage (for example, a high voltage of opposite polarity (+) as the toner charging polarity (−)) is applied to the transfer roller 11*a* of the secondary transfer apparatus 11 in order to transfer the toner images of each color on the intermediate transfer belt 7 to the recording material. Furthermore, in order to steadily obtain that nip region, either the transfer roller 11*a* of the secondary transfer apparatus 11 or the intermediate transfer belt drive roller 21 is made of a hard material (such as metal), and the other is made of a soft material such as an elastic roller (such as an elastic rubber roller or a foam resin roller).

Toner may remain on the intermediate transfer belt 7, without the toner image on the intermediate transfer belt 7 being completely transferred onto the recording material by the secondary transfer apparatus 11. This remaining toner causes toner color mixing to occur in the next step, and therefore the remaining toner is removed and collected by the intermediate transfer belt cleaning apparatus 9. The intermediate transfer belt cleaning apparatus 9 is provided with a cleaning blade that contacts the intermediate transfer belt 7 as a cleaning member, for example, and the remaining toner can be removed and collected by the cleaning blade. The driven roller 22 supports the intermediate transfer belt 7 from the inside (back side), and the cleaning blade contacts the intermediate transfer belt 7 such that the cleaning blade presses from the outside toward the driven roller 22.

The paper feed tray 10 is a tray for storing recording material, and is provided on the lower side of an image forming unit of the apparatus main body A. The discharge tray 15 provided on the upper side of the image forming unit is a tray for placing printed recording material face-down.

The apparatus main body A is provided with the transport apparatus 18 for feeding recording material of the paper feed tray 10 through the secondary transfer apparatus 11 and the fixing apparatus 12 to the discharge tray 15. The transport apparatus 18 has an S-shaped transport path S, and disposed along the transport path S are transport members such as a pickup roller 16, transport rollers 13, a pre-registration roller 19, a registration roller 14, the fixing apparatus 12, a discharge roller 17, and so forth.

The pickup roller 16 is provided at a downstream end in the recording material transport direction of the paper feed tray 10, and is a pick-up roller that supplies recording material from the paper feed tray 10 page-by-page to the transport path S. The transport rollers 13 and the pre-registration roller 19 are small rollers for promoting/assisting transport of the recording material. The transport rollers 13 are provided in a plurality of locations along the transport path S. The pre-registration rollers 19 are provided near the upstream side in the transport direction of the registration roller 14, and transport the recording material to the registration roller 14.

The registration roller 14 temporarily stops the recording material transported by the pre-registration roller 19, aligns the leading edge of the recording material, and then transports the recording material in a timely manner, in coordination with rotation of the photosensitive drum 3 and the intermediate transfer belt 7, such that the color toner image on the intermediate transfer belt 7 is transferred to the recording material in the nip region between the intermediate transfer belt 7 and the secondary transfer apparatus 11.

For example, the registration roller 14 transports the recording material, such that the leading edge of the color toner image on the intermediate transfer belt 7 matches the leading edge of an image forming range in the recording material in the nip region between the intermediate transfer belt 7 and the secondary transfer apparatus 11.

The fixing apparatus 12 receives the recording material onto which a toner image has been transferred, and transports this recording material sandwiched between a heat roller 31 and a pressure roller 32.

The heat roller 31 is temperature-controlled to become a predetermined fixing temperature, and by applying heat and pressure to the recording material along with the pressure roller 32, melts, mixes, and presses against the toner image transferred to the recording material, thus thermally fixing the toner image to the recording material.

After fixing of the toner images of each color, the recording material is discharged onto the discharge tray 15 by the discharge roller 17.

It is also possible to form a monochrome image using at least one among the four image forming stations, and transfer the monochrome image to the intermediate transfer belt 7 of the intermediate transfer belt apparatus 8. As in the case of a color image, this monochrome image is transferred from the intermediate transfer belt 7 to a recording material, and fixed on the recording material.

Also, when image forming is performed not only on the front (back) face of the recording material, but rather duplex image forming is performed, after an image for the front face of the recording material has been fixed by the fixing apparatus 12, while the recording material is being transported by the discharge roller 17 in the transport path S, the discharge roller 17 is stopped and then rotated in reverse, the front and back of the recording material are reversed by passing the recording material through a front/back reversing path Sr, and then the recording material is again guided to the registration roller 14, and as in the case of the front face of the recording material, an image is recorded to the back face of the recording material and fixed, and then the recording material is discharged to the discharge tray 15.

The color image forming apparatus D is furthermore provided with a driving apparatus 100*a* that drives the photosensitive drum 3 (not shown in FIG. 1; see FIGS. 2 and 3 described below).

Configuration of Driving Apparatus

Figure 2:
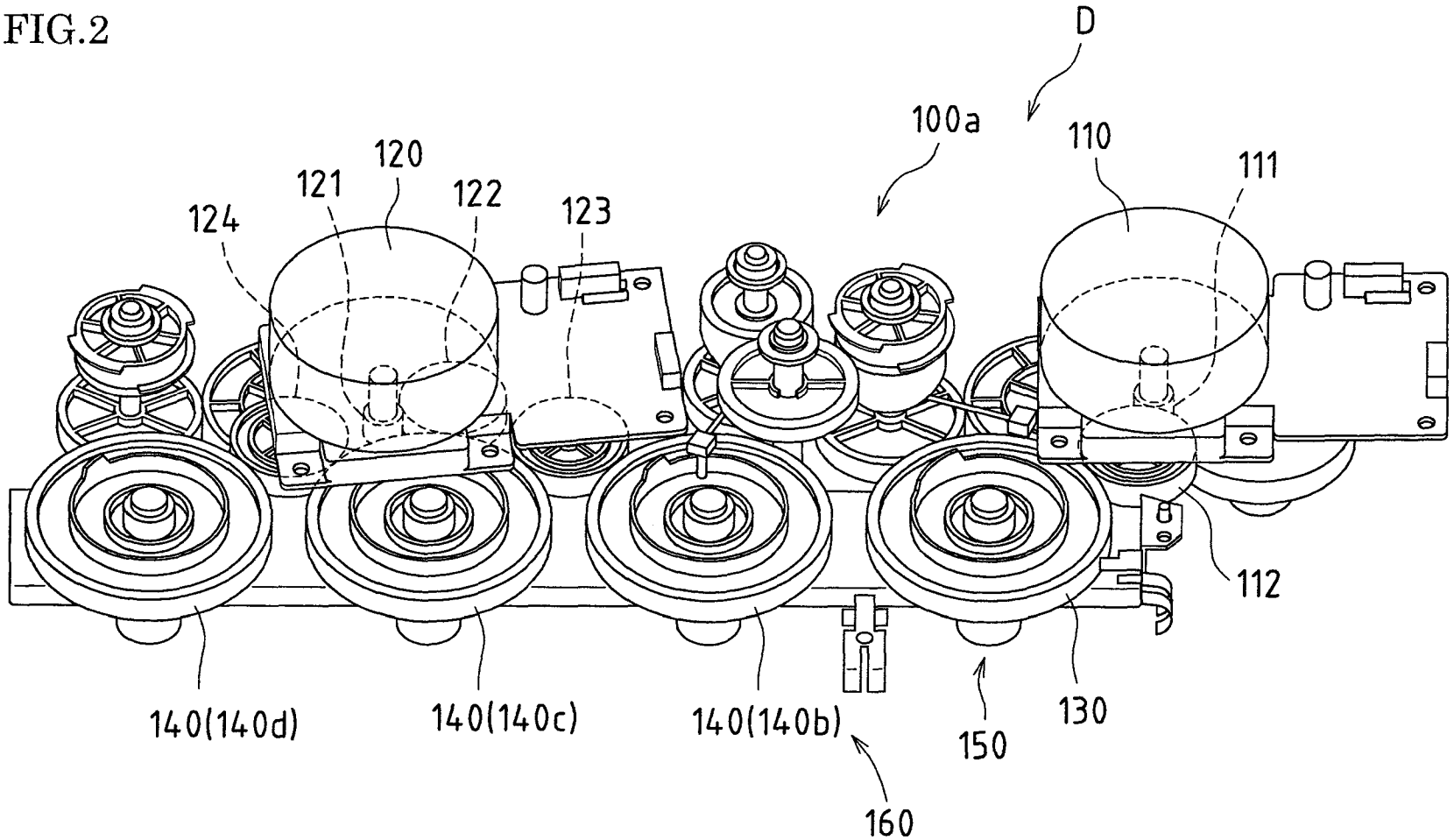
FIG. 2 is a detailed perspective view of a driving apparatus in the color image forming apparatus shown in FIG. 1.
Figure 3:
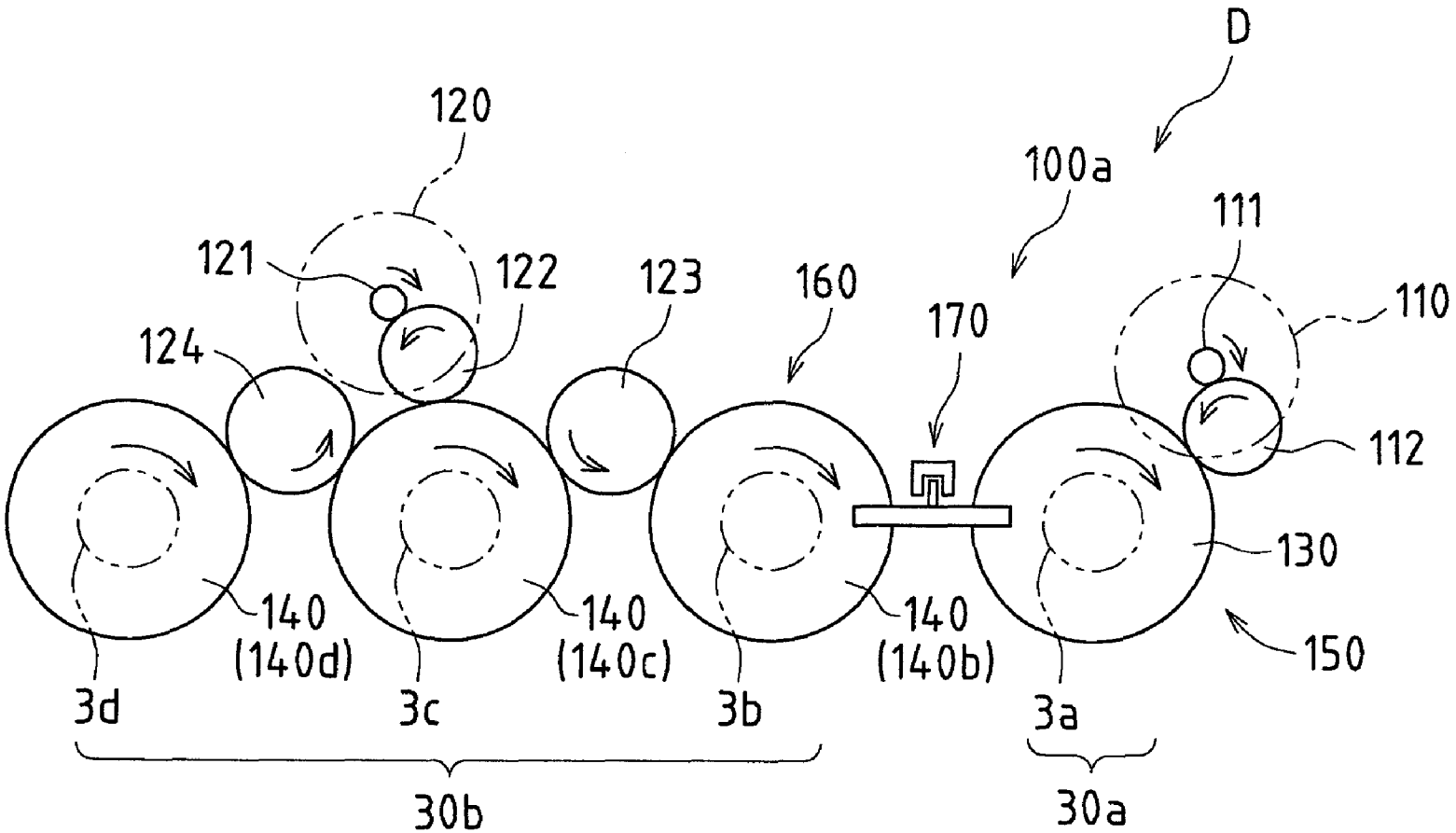
FIG. 3 is a system configuration diagram that schematically shows a drive transmission system of the driving apparatus in FIG. 2, and shows a gear train that transmits rotational drive from a drive unit to a photosensitive drum, and a detection sensor.

Next is a description of the driving apparatus 100*a*, with reference to FIGS. 2 and 3. Note that in the below description, the suffix letter of reference 3 indicating the photosensitive drum and the suffix letter of reference 2 indicating the development apparatus are not omitted. That is, the description below refers to photosensitive drums 3*a*, 3*b*, 3*c*, and 3*d*, and development apparatuses (here, development units) 2*a*, 2*b*, 2*c*, and 2*d*.

FIG. 2 is a detailed perspective view of the driving apparatus 100*a* in the color image forming apparatus D shown in FIG. 1. FIG. 3 is a system configuration diagram that schematically shows a drive transmission system of the driving apparatus 100*a* shown in FIG. 2, and shows a gear train that transmits rotational drive from drive units 110 and 120 to the photosensitive drums 3*a*, 3*b*, 3*c*, and 3*d*, and a detection sensor 170. The detection sensor 170 is not shown in FIG. 2.

The color image forming apparatus D is provided with a first group photosensitive body 30*a* (an example of a first group image carrier) to which at least one photosensitive drum (here, the black photosensitive drum 3*a*) among the photosensitive drums 3*a*, 3*b*, 3*c*, and 3*d* belongs, and a second group photosensitive body 30*b* (an example of a second group image carrier) to which the remaining photosensitive drums 3*b*, 3*c*, and 3*d* (here, the cyan photosensitive drum 3*b*, the magenta photosensitive drum 3*c*, and the yellow photosensitive drum 3*d*) belong. That is, here, the first group photosensitive body 30*a* is a photosensitive body for performing monochrome image forming (monochrome printing), and the second group photosensitive body 30*b* is a photosensitive body for performing full-color image forming in collaboration with the first group photosensitive body 30*a*.

The driving apparatus 100*a* is further provided with a first drive unit 110, a second drive unit 120, a first rotation member (here, a first drive transmission rotation member) 150, and a second rotation member (here, a second drive transmission rotation member) 160.

The first drive unit 110 is a drive unit for driving the first group photosensitive body 30*a*. The second drive unit 120 is a drive unit for driving the second group photosensitive body 30*b*. Here, the first drive unit 110 and the second drive unit 120 are stepper motors.

The first drive transmission rotation member 150 transmits rotational drive from the first drive unit 110 to the first group photosensitive body 30*a*, and here, includes a first shaft gear 111, a first intermediate gear 112, and a black photosensitive body drive gear 130. The second drive transmission rotation member 160 transmits rotational drive from the second drive unit 120 to the second group photosensitive body 30*b*, and here, includes a second shaft gear 121, second to fourth intermediate gears 122 to 124, and color (cyan, magenta, and yellow) photosensitive body drive gears 140*b* to 140*d*. The rotational axis lines of these gears are parallel to each other.

Specifically, the black photosensitive body drive gear 130 is coaxially linked to a rotating shaft of the black photosensitive drum 3*a*, and is engaged with the first intermediate gear 112. The first shaft gear 111 is provided on a rotating shaft of the first drive unit 110 and is engaged with the first intermediate gear 112. Thus, by rotational driving of the first drive unit 110, the black photosensitive drum 3*a* that is linked to the black photosensitive body drive gear 130 can be caused to rotate via the first shaft gear 111, the first intermediate gear 112, and the black photosensitive body drive gear 130.

Also, the cyan photosensitive body drive gear 140*b* is coaxially linked to a rotating shaft of the cyan photosensitive drum 3*b*, and is engaged with the third intermediate gear 123. The magenta photosensitive body drive gear 140*c* is coaxially linked to a rotating shaft of the magenta photosensitive drum 3*c*, and is engaged with the second intermediate gear 122, the third intermediate gear 123, and the fourth intermediate gear 124. The yellow photosensitive body drive gear 140*d* is coaxially linked to a rotating shaft of the yellow photosensitive drum 3*d*, and is engaged with the fourth intermediate gear 124. The second shaft gear 121 is provided on a rotating shaft of the second drive unit 120 and is engaged with the second intermediate gear 122. Thus, by rotational driving of the second drive unit 120, the magenta photosensitive drum 3*c* that is linked to the magenta photosensitive body drive gear 140*c* can be caused to rotate via the second shaft gear 121, the second intermediate gear 122, and the magenta photosensitive body drive gear 140*c*; the cyan photosensitive drum 3*b* that is linked to the cyan photosensitive body drive gear 140*b* can be caused to rotate via the magenta photosensitive body drive gear 140*c*, the third intermediate gear 123, and the cyan photosensitive body drive gear 140*b*; and the yellow photosensitive drum 3*d* that is linked to the yellow photosensitive body drive gear 140*d* can be caused to rotate via the magenta photosensitive body drive gear 140*c*, the fourth intermediate gear 124, and the yellow photosensitive body drive gear 140*d*.

Thus, the second drive unit 120 of the color photosensitive drums 3*b*, 3*c*, and 3*d* can be a shared drive unit. Also, it is possible for the first drive unit 110 to cause the photosensitive drum 3*a* to rotate individually when performing monochrome printing.

The first drive unit 110 also drives the black development unit 2*a*, and the second drive unit 120 also drives the cyan development unit 2*b*, the magenta development unit 2*c*, and the yellow development unit 2*d*.

Here, the black photosensitive body drive gear 130 serves as a first gear, and among the color photosensitive body drive gears 140 (140*b*, 140*c*, and 140*d*), the cyan photosensitive body drive gear 140*b* serves as a second gear.

(First Embodiment)

In the image forming apparatus D shown in FIG. 1, the driving apparatus 100*a* shown in FIGS. 2 and 3 is further provided with the single detection sensor 170 (FIG. 3), which detects a first detection information for identifying a rotation timing of the first group photosensitive body 30*a* and also detects a second detection information for identifying a rotation timing of the second group photosensitive body 30*b*.

According to the first embodiment, the first detection information is detected and the second detection information is detected by the single detection sensor 170. Therefore, it is possible to detect rotation phase of the first group photosensitive body 30*a* and the second group photosensitive body 30*b* while the number of detection sensors that perform phase matching from rotational irregularity of the first group photosensitive body 30*a* and the second group photosensitive body 30*b* is as small as possible, and thus simplified apparatus configuration and decreased cost can be realized. Here, by the single detection sensor 170 performing phase matching from rotational irregularity of the first group photosensitive body 30*a* for performing monochrome image forming, and the second group photosensitive body 30*b* for performing full-color image forming in collaboration with the first group photosensitive body 30*a*, it is possible to reduce color shift due to phase shift, and thus it is possible to achieve a reduction in cost.

In the first embodiment, the first detection information and the second detection information are caused to differ from each other, such that a difference between the rotation timing of the first group photosensitive body 30*a* and the rotation timing of the second group photosensitive body 30*b* can be identified by the single detection sensor 170. That is, the first detection information is information that can be identified as being information of the first group photosensitive body 30*a* relative to the second detection information, and the second detection information is information that can be identified as being information of the second group photosensitive body 30*b* relative to the first detection information.

By adopting such a configuration in which the first detection information and the second detection information are caused to differ from each other, such that a difference between the rotation timing of the first group photosensitive body 30*a* and the rotation timing of the second group photosensitive body 30*b* can be identified by the single detection sensor 170, it is possible to easily identify a difference between the first detection information and the second detection information, and accordingly, it is possible to identify which direction the rotation position of which group photosensitive body among the first group photosensitive body 30*a* and the second group photosensitive body 30*b* should be changed (for example, which group photosensitive body's speed should be increased, or should be decreased).

Figures 4A, 4B, 4C, 4D, 4E, 4F, 4G:
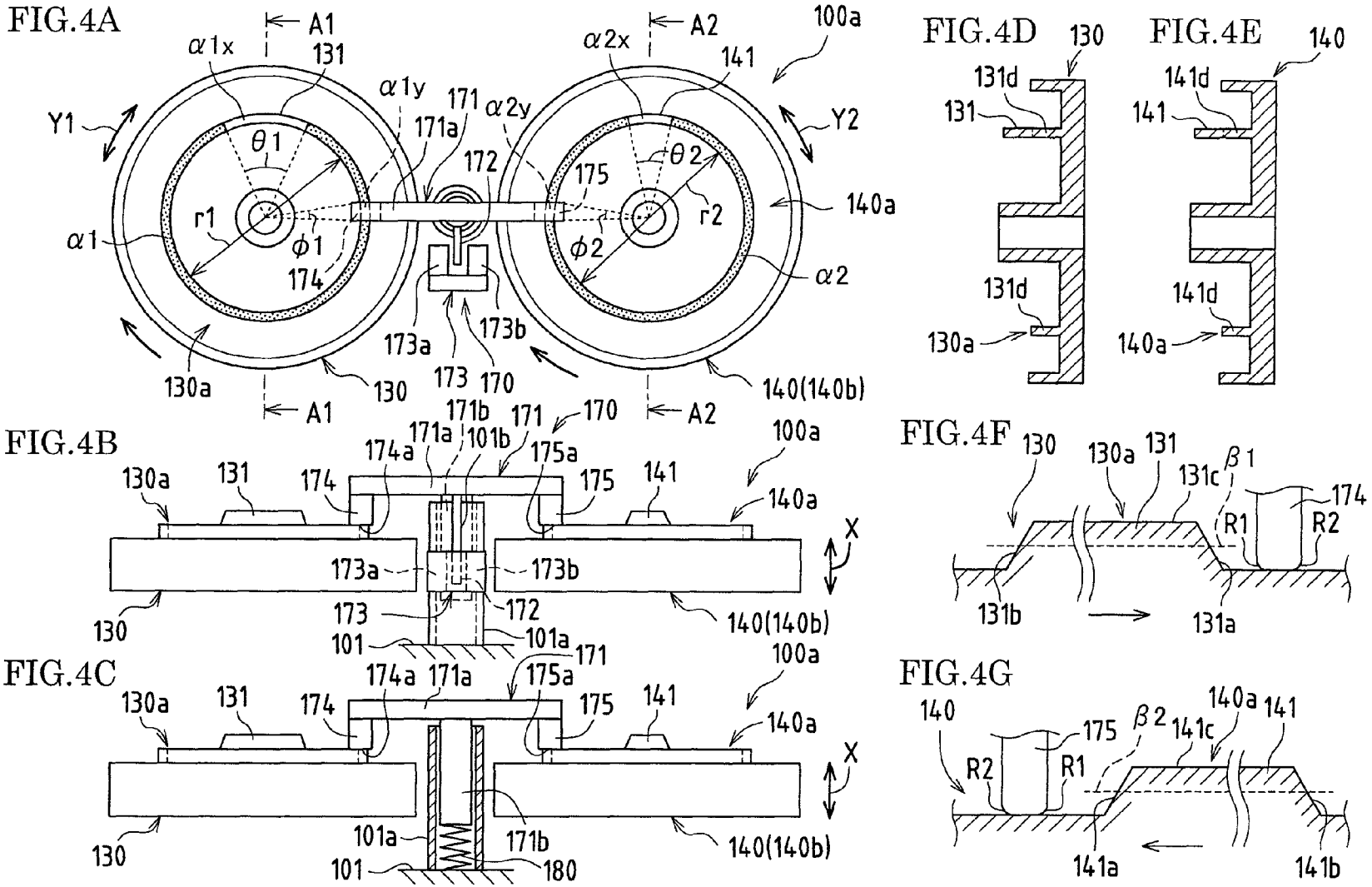
FIG. 4A illustrates a detection state of a first gear and a second gear by a detection sensor in a first embodiment, and is a schematic side view thereof.
FIG. 4B illustrates a detection state of the first gear and the second gear by the detection sensor in the first embodiment, and is a schematic plan view thereof.
FIG. 4C illustrates a detection state of the first gear and the second gear by the detection sensor in the first embodiment, and includes a partial cross-section showing an energizing member in FIG. 4B.
FIG. 4D illustrates a detection state of the first gear and the second gear by the detection sensor in the first embodiment, and is a schematic cross-sectional view taken along line A1-A1 in FIG. 4A.
FIG. 4E illustrates a detection state of the first gear and the second gear by the detection sensor in the first embodiment, and is a schematic cross-sectional view taken along line A2-A2 in FIG. 4A.
FIG. 4F illustrates a detection state of the first gear and the second gear by the detection sensor in the first embodiment, and is a schematic cross-sectional view in which a first opposing portion that opposes a first gear side face is viewed from the center of rotation of the first gear.
FIG. 4G illustrates a detection state of the first gear and the second gear by the detection sensor in the first embodiment, and is a schematic cross-sectional view in which a second opposing portion that opposes a second gear side face is viewed from the center of rotation of the second gear.

This is described in more detail with reference to FIGS. 4A to 4G and FIG. 5. FIGS. 4A to 4G illustrate a detection state of the first gear 130 and the second gear 140 by the detection sensor 170 in the first embodiment. FIG. 4A is a schematic side view thereof. FIG. 4B is a schematic plan view thereof. FIG. 4C shows an energizing member 180 in FIG. 4B. FIG. 4D is a schematic cross-sectional view taken along line A1-A1 in FIG. 4A. FIG. 4E is a schematic cross-sectional view taken along line A2-A2 in FIG. 4A. FIG. 4F is a schematic cross-sectional view in which a first opposing portion 174 that opposes a first gear side face 130*a* is viewed from the center of rotation of the first gear 130. FIG. 4G is a schematic cross-sectional view in which a second opposing portion 175 that opposes a second gear side face 140*a* is viewed from the center of rotation of the second gear 140.

Figure 5:
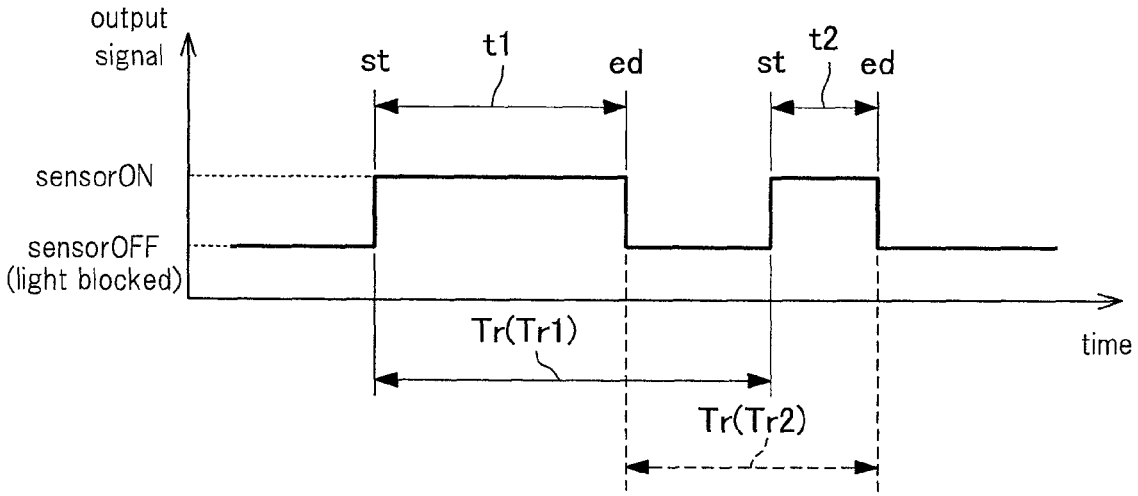
FIG. 5 illustrates a first detection information and a second detection information, and shows an output signal from a detection sensor.

FIG. 5 illustrates the first detection information and the second detection information, and shows an output signal from the detection sensor 170.

As shown in FIGS. 4A to 4G, the detection sensor 170 includes an actuator unit 171, a detected portion 172, and a sensor unit 173. The actuator unit 171 is capable of moving back-and-forth in a rotational axis line direction (the direction of arrow X in FIGS. 4B and 4C). The detected portion 172 is provided in the actuator unit 171, and is detected by the sensor unit 173.

The first opposing portion 174 and the second opposing portion 175 are provided in the actuator unit 171. In the first opposing portion 174, a detection face 174*a* opposes the side face (referred to below as the first gear side face) 130*a*, which is orthogonal to the rotational axis line direction X of the first gear 130. In the second opposing portion 175, a detection face 175*a* opposes the side face (referred to below as the second gear side face) 140*a*, which is orthogonal to the rotational axis line direction X of the second gear 140.

Note that in the first embodiment, the cyan photosensitive body drive gear 140*b* serves as the subject of detection in the second gear 140 by the detection sensor 170, because the cyan photosensitive body drive gear 140*b* is near the first gear 130. The first gear 130 may also be the intermediate gear 112. Also, the second gear 140 may be any of the drive gears 140*c* and 140*d* and the intermediate gears 121 to 123.

In the first embodiment, the first detection information includes information of a first rotation angle θ1 of the first group photosensitive body 30*a*. The second detection information includes information of a second rotation angle θ2 of the second group photosensitive body 30*b*. Thus, it is possible for the detection sensor 170 to detect the rotation phase of the first group photosensitive body 30*a* and the second group photosensitive body 30*b* with a comparatively simple configuration.

More specifically, in the first gear side face 130*a*, a first cam unit 131 is provided in part of a circular first opposing region al that opposes the first opposing portion 174 in the circumferential direction (direction Y1 in FIG. 4A). The first cam unit 131 is constituted by a first convex portion or a first concave portion (here, a first convex portion) in the circumferential direction Y1. Also, in the second gear side face 140*a*, a second cam unit 141 is provided in part of a circular second opposing region α2 that opposes the second opposing portion 175 in the circumferential direction (direction Y2 in FIG. 4A). The second cam unit 141 is constituted by a second convex portion or a second concave portion (here, a second convex portion) in the circumferential direction Y2. The first cam unit 131 can be provided at any position in the first opposing region α1 in the circumferential direction Y1. The second cam unit 141 can be provided at any position in the second opposing region α2 in the circumferential direction Y2.

In the first embodiment, the size (for example, a first inner diameter r1) of the first opposing region α1 in the first gear side face 130*a* is the same as the size (for example, a second inner diameter r2) of the second opposing region α2 in the second gear side face 140*a*.

Also, the first rotation angle θ1 differs from the second rotation angle θ2. Here, the circumferential speed is the same for the first gear 130 and the second gear 140. Thus, it is possible to easily identify a difference between the first detection information and the second detection information.

More specifically, as shown in FIG. 5, the first detection information includes a first detection time t1 when the first rotation angle θ1 of the first group photosensitive body 30*a* was detected, and the second detection information includes a second detection time t2 (here, t1>t2) when the second rotation angle θ2 (here, θ1>θ2) of the second group photosensitive body 30*b* was detected that differs from the first detection time t1. The rotation phase of the first group photosensitive body 30*a* and the second group photosensitive body 30*b* can be detected by calculating a difference Tr (Tr1) between a detection start st of the first detection time t1 of the first group photosensitive body 30*a* and the detection start st of the second detection time t2 of the second group photosensitive body 30*b*, or by calculating a difference Tr (Tr2) between a detection end ed of the first detection time t1 of the first group photosensitive body 30*a* and the detection end ed of the second detection time t2 of the second group photosensitive body 30*b*.

In the first embodiment, the first opposing portion 174 and the first cam unit 131 are formed such that the first detection time t1 is detected by the sensor unit 173 entering a detection state and a non-detection state due to back-and-forth movement of the detected portion 172 according to back-and-forth movement of the actuator unit 171 in the rotational axis line direction X. Also, the second opposing portion 175 and the second cam unit 141 are formed such that the second detection time t2 is detected by the sensor unit 173 entering a detection state and a non-detection state due to back-and-forth movement of the detected portion 172 according to back-and-forth movement of the actuator unit 171 in the rotational axis line direction X.

In this driving apparatus 100*a*, the first gear 130 and the second gear 140 rotate when detection of the first detection time t1 and the second detection time t2 is performed.

In the first gear 130, when the first cam unit 131 moves to the first opposing portion 174, the first opposing portion 174 is pushed upward at one end of the first cam unit 131. Thus, the detected portion 172 also is pushed upward via the actuator unit 171, and at a first detection position β1 (see FIG. 4F) of the first cam unit 131, the sensor unit 173 changes from a non-detection state (a state in which the detected portion 172 is blocked from light) to a detection state (a state in which the detected portion 172 is not blocked from light), or from the detection state to the non-detection state (here, from the non-detection state to the detection state). This time is the detection start st of the first detection time t1 by the detection sensor 170 (see FIG. 5). When the first gear 130 further rotates, the first opposing portion 174 is lowered at the other end of the first cam unit 131. Thus, the detected portion 172 also is lowered via the actuator unit 171, and at the first detection position β1 of the first cam unit 131, the sensor unit 173 changes from the detection state to the non-detection state, or from the non-detection state to the detection state (here, from the detection state to the non-detection state). This time is the detection end ed of the first detection time t1 by the detection sensor 170 (see FIG. 5).

Likewise, in the second gear 140, when the second cam unit 141 moves to the second opposing portion 175, the second opposing portion 175 is pushed upward at one end of the second cam unit 141. Thus, the detected portion 172 also is pushed upward via the actuator unit 171, and at a second detection position β2 (see FIG. 4G) of the second cam unit 141, the sensor unit 173 changes from the non-detection state to the detection state, or from the detection state to the non-detection state (here, from the non-detection state to the detection state). This time is the detection start st of the second detection time t2 by the detection sensor 170 (see FIG. 5). When the second gear 140 further rotates, the second opposing portion 175 is lowered at the other end of the second cam unit 141. Thus, the detected portion 172 also is lowered via the actuator unit 171, and at the second detection position β2 of the second cam unit 141, the sensor unit 173 changes from the detection state to the non-detection state, or from the non-detection state to the detection state (here, from the detection state to the non-detection state). This time is the detection end ed of the second detection time t2 by the detection sensor 170 (see FIG. 5).

By thus detecting the first rotation angle θ1 of the first group photosensitive body 30*a*, it is possible to detect the first detection time t1 of the first gear 130, and by detecting the second rotation angle θ2 of the second group photosensitive body 30*b*, which differs from the first rotation angle θ1, it is possible to detect the second detection time t2 of the second gear 140, which differs from the first detection time U. Thus, it is possible to easily detect the rotation phase of the first group photosensitive body 30*a* and the second group photosensitive body 30*b* with the single detection sensor 170.

In the first embodiment, as shown in FIGS. 4F and 4G, the first cam unit 131 and the second cam unit 141 have ascending slope portions 131*a* and 141*a*, and descending slope portions 131*b* and 141*b*. Therefore, the first opposing portion 174 and the second opposing portion 175 can be caused to smoothly slide relative to the first cam unit 131 and the second cam unit 141, and thus it is possible to suppress shocks to the first group photosensitive body 30*a* and the second group photosensitive body 30*b* due to the sliding, and to that extent it is possible to obtain a better image.

The first detection position β1, here, is an intermediate position of the ascending slope portion 131*a* and an intermediate position of the descending slope portion 131*b* of the first convex portion. The second detection position β2, here, is an intermediate position of the ascending slope portion 141*a* and an intermediate position of the descending slope portion 141*b* of the second convex portion.

As shown in FIG. 4D, the first cam unit 131 is formed in a rib 131*d* along the first opposing region αl in the first gear side face 130*a*, and as shown in FIG. 4E, the second cam unit 141 is formed in a rib 141*d* along the second opposing region α2 in the second gear side face 140*a*. Thus, the above configuration is easily applicable to a gear having a rib, as in the conventional technology.

Also, as shown in FIG. 4F, among corner portions R1 and R2 at both ends along the first opposing region α1 in the first opposing portion 174, at least one (here, both ends) has the form of a curved face. Also, as shown in FIG. 4G, among corner portions R1 and R2 at both ends along the second opposing region α2 in the second opposing portion 175, at least one (here, both ends) has the form of a curved face. Therefore, the first cam unit 131 and the second cam unit 141 can be caused to smoothly slide relative to the first opposing portion 174 and the second opposing portion 175, and thus it is possible to suppress shocks to the first group photosensitive body 30*a* and the second group photosensitive body 30*b*, and to that extent it is possible to obtain a better image.

Also, flat portions 131*c* and 141*c* orthogonal to the rotational axis line direction X are between the ascending slope portions 131*a* and 141*a* and the descending slope portions 131*b* and 141*b*. Thus, a detection state or a non-detection state by the detection sensor 170 can be insured at the flat portions 131*c* and 141*c*, and to that extent it is possible to more stably detect the first detection time t1 and the second detection time t2.

Here, the sensor unit 173 is a permeable light sensor provided with a light-emitting portion 173*a* and a light-receiving portion 173*b*. By blocking or allowing passage of incident light that is incident on the light-receiving portion 173*b* from the light-emitting portion 173 at the detected portion 172 by back-and-forth movement of the detected portion 172 according to back-and-forth movement of the actuator unit 171 in the rotational axis line direction X, the sensor unit 173 detects presence of the incident light at the light-receiving portion 173*b*. The sensor unit 173 may also be a reflective-type light sensor.

A rotation angle of an arc-like detection region α1*x* formed along the first opposing region α1 of the first cam unit 131 serves as the first rotation angle θ1. And a rotation angle of an arc-like detection region α2*x* formed along the second opposing region α2 of the second cam unit 141 serves as the second rotation angle θ2. Also, a first center angle □1 of an arc-like detection region α1*y* formed along the first opposing region α1 opposing the first opposing portion 174 in the actuator unit 171 is equal to a second center angle □2 of an arc-like detection region α2*y* formed along the second opposing region α2 opposing the second opposing portion 175 in the actuator unit 171.

The actuator unit 171 may also be energized toward the first gear 130 and the second gear 140 by the weight of the actuator unit 171, but in the first embodiment, as shown in FIG. 4C, the actuator unit 171 is energized toward the first gear 130 and the second gear 140 by the energizing member 180. Thus, with the energizing member 180 it is possible to reliably cause the first opposing portion 174 and the second opposing portion 175, and the first cam unit 131 and the second cam unit 141, to slide, and to that extent it is possible to more stably detect the first detection time t1 and the second detection time t2 with the detection sensor 170.

Specifically, the actuator unit 171 is formed in a T-shape viewed from above (see FIG. 4C), and is constituted from a spanning portion 171*a* and a sliding portion 171*b*. The spanning portion 171*a* spans across the first gear 130 and the second gear 140, and is supported by the sliding portion 171*b*. One end of the spanning portion 171*a* supports the first opposing portion 174, and the other end supports the second opposing portion 175. Here, the length of the spanning portion 171*a* is the same on the first opposing portion 174 side and the second opposing portion 175 side, with the sliding portion 171*b* therebetween. Also, the length in the rotational axis line direction X is the same for the first opposing portion 174 and the second opposing portion 175. The sliding portion 171*b* is extended in the rotational axis line direction X, and is slidably housed in a cavity portion 101*a* that extends in the rotational axis line direction X and is provided in a side plate 101 of the driving apparatus 100*a*. The sliding portion 171*b* is provided at a middle position between the first gear 130 and the second gear 140, relative to the spanning portion 171*a*. The detection sensor 170 is provided in a support member (not shown) provided in the side plate 101.

The detected portion 172 is provided on an outer side face of the sliding portion 171*b*. A notched guide portion 101*b* is formed in the cavity portion 101*a* so as to guide the detected portion 172 in the rotational axis line direction X. Here, the energizing member 180 is a coil spring, and is housed in a tip end side of the sliding portion 171*b* housed in the cavity portion 101*a*. In the energizing member 180, one end 181 is linked to the side plate 101, and the other end 182 is linked to the sliding portion 171*b*, so as to energize the actuator unit 171 toward the first gear 130 and the second gear 140.

In the first embodiment, the first and second cam units 131 and 141 serve as the first and second convex portions, but may also serve as first and second concave portions.

Also, in the first embodiment, the first rotation angle θ1 is larger than the second rotation angle θ2, and the first detection time t1 is longer than the second detection time t2, but a configuration may also be adopted in which the first rotation angle θ1 is smaller than the second rotation angle θ2, and the first detection time t1 is shorter than the second detection time t2.

Also, in the first embodiment, the first rotation angle θ1 in the first cam unit 131 is different from the second rotation angle θ2 in the second cam unit 141, and the first center angle □1 for the first opposing portion 174 of the actuator unit 171 is equal to the second center angle □2 for the second opposing portion 175 of the actuator unit 171, but a configuration may also be adopted in which the first center angle □1 for the first opposing portion 174 of the actuator unit 171 differs from the second center angle □2 for the second opposing portion 175 of the actuator unit 171, and the first rotation angle θ1 in the first cam unit 131 is equal to the second rotation angle θ2 in the second cam unit 141. Also, the first opposing portion 174 and the second opposing portion 175 may have an ascending slope portion and a descending slope portion.

Also, in the first embodiment, the first gear 130 is provided coaxially with the photosensitive body 3*a* in the first group photosensitive body 30*a*, and the second gear 140 is provided coaxially with the photosensitive body 3*b* in the second group photosensitive body 30*b*. By thus performing detection with the gears 130 and 140 provided coaxially with the photosensitive bodies 3*a* and 3*b*, it is possible to reduce the difference in the degree of rotation between the photosensitive bodies 3*a* and 3*b* and the gears 130 and 140, and to that extent it is possible to precisely perform phase matching.

(Second Embodiment)

Figure 6D:
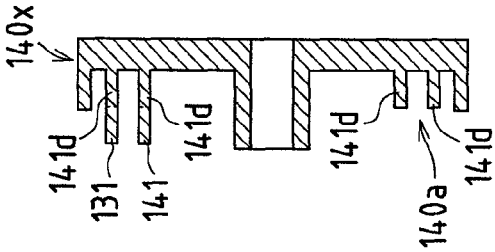
FIG. 6D is a schematic cross-sectional view taken along line A2-A2 in FIG. 6A.
Figure 6C:
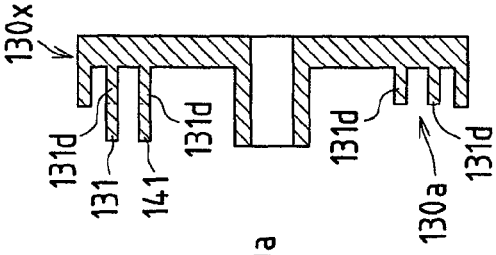
FIG. 6C is a schematic cross-sectional view taken along line A1-A1 in FIG. 6A.
Figure 6A:
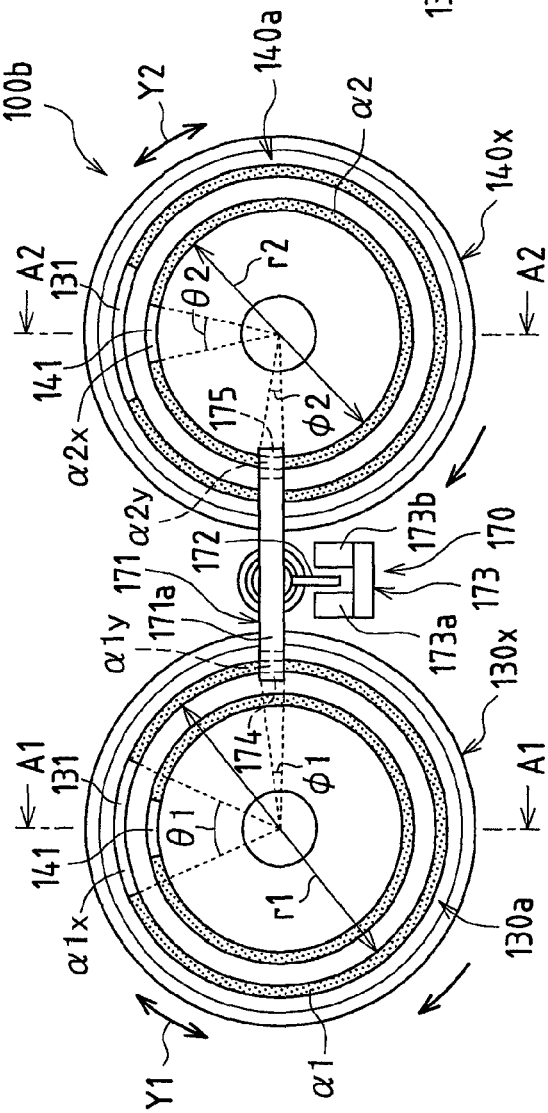
FIG. 6A illustrates a second embodiment, and is a schematic side view thereof.
Figure 6B:
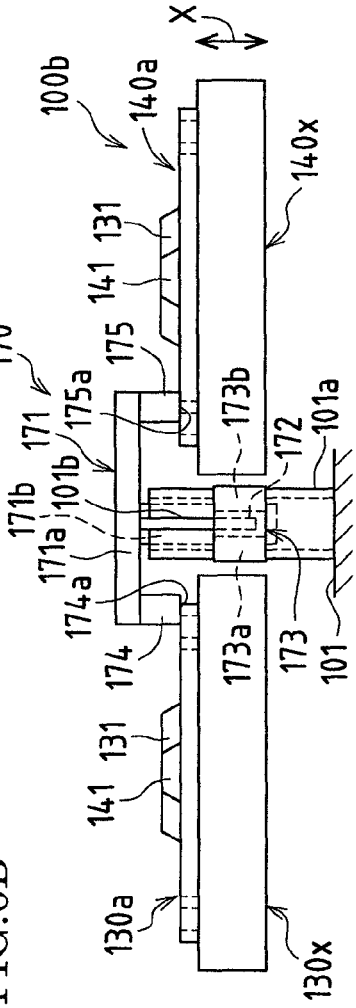
FIG. 6B illustrates a second embodiment, and is a schematic plan view thereof.

Next is a description of a driving apparatus 100*b* that is another embodiment (second embodiment) of the invention and differs from the first embodiment shown in FIGS. 4A to 4G. FIGS. 6A to 6D illustrate the second embodiment. FIG. 6A is a schematic side view thereof. FIG. 6B is a schematic plan view thereof. FIG. 6C is a schematic cross-sectional view taken along line A1-A1 in FIG. 6A. FIG. 6D is a schematic cross-sectional view taken along line A2-A2 in FIG. 6A. In FIGS. 6A to 6D, constituent elements that are substantially the same as in the first embodiment are given the same reference symbols, and a description thereof is omitted here. This is also true with respect to FIGS. 7A to 7F of a third embodiment described below.

In the second embodiment, a first gear 130*x* and a second gear 140*x* are provided instead of the first gear 130 and the second gear 140 of the first embodiment.

The size (for example, a first inner diameter r1) of the first opposing region α1 in the first gear side face 130*a* of the first gear 130*x* is different from the size (for example, a second inner diameter r2) of the second opposing region α2 in the second gear side face 140*a* of the second gear 140*x* (here, r1>r2). In the first gear 130*x*, in addition to the first cam unit 131, the second cam unit 141 provided in the second gear 140*x* is provided when the first gear 130*x* serves as the second gear 140*x*. In the second gear 140*x*, in addition to the second cam unit 141, the first cam unit 131 provided in the first gear 130*x* is provided when the second gear 140*x* serves as the first gear 130*x*. Thus, it is possible to share components between the first gear 130*x* and the second gear 140*x*, and thus, it becomes easier to match the rotational irregularity cycles of the respective group photosensitive bodies 30*a* and 30*b*, and component cost can be kept down.

Here, the spanning portion 171*a* supports the first opposing portion 174 and the second opposing portion 175 such that the first opposing portion 174 and the second opposing portion 175 respectively oppose the first opposing region α1 and the second opposing region α2 (here, in a state with the sliding portion 171*b* therebetween and being longer on the side of the second opposing portion 175).

Note that the first inner diameter r1 of the first opposing region α1 is larger than the second inner diameter r2 of the second opposing region α2, but may also be smaller than the second inner diameter r2 of the second opposing region α2.

(Third Embodiment)

Figures 7A, 7B, 7C, 7D, 7E, 7F:
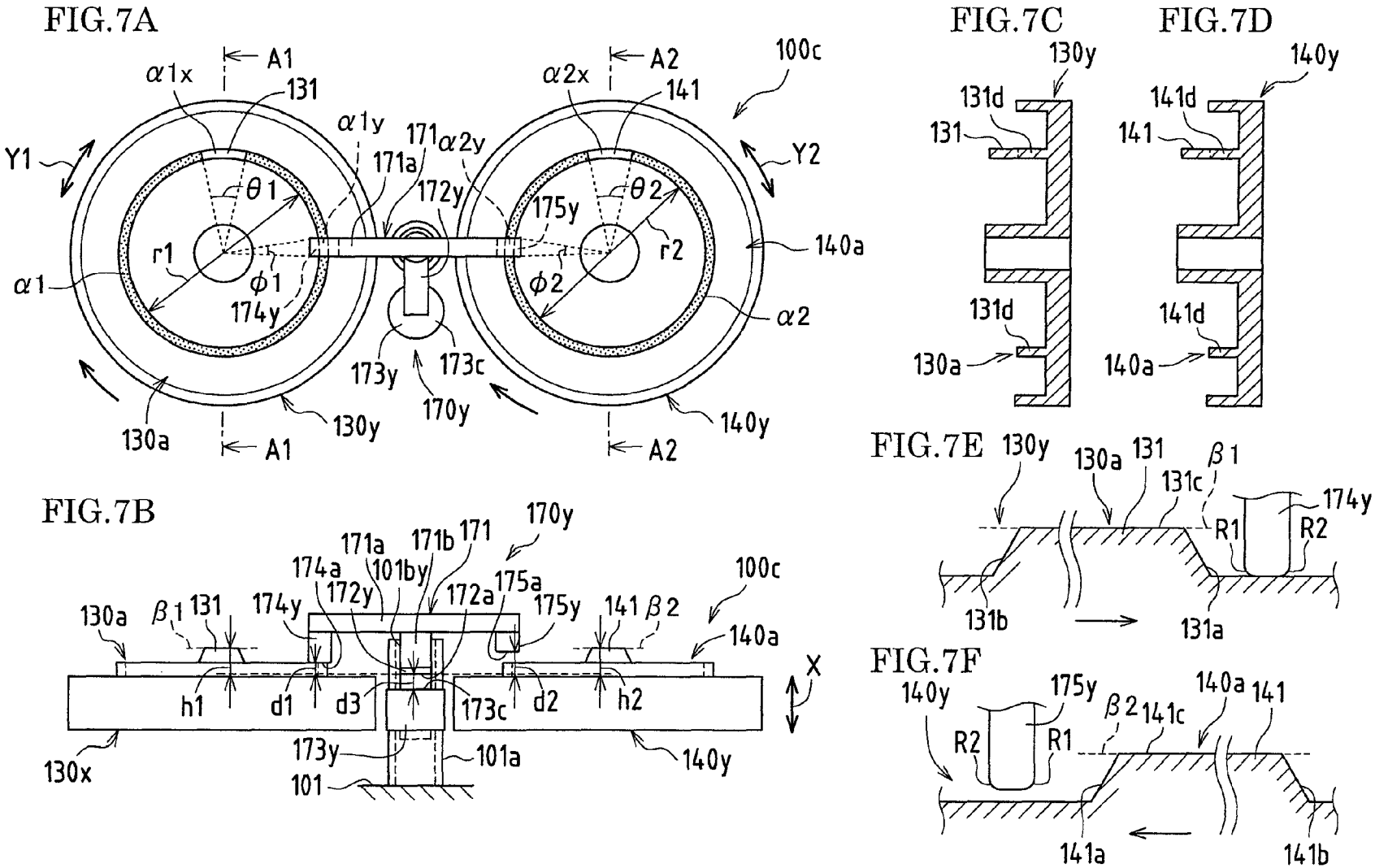
FIG. 7A illustrates a third embodiment, and is a schematic side view thereof.
FIG. 7B illustrates the third embodiment, and is a schematic plan view thereof.
FIG. 7C illustrates the third embodiment, and is a schematic cross-sectional view taken along line A1-A1 in FIG. 7A.
FIG. 7D illustrates the third embodiment, and is a schematic cross-sectional view taken along line A2-A2 in FIG. 7A.
FIG. 7E illustrates the third embodiment, and is a schematic cross-sectional view in which a first opposing portion that opposes a first gear side face is viewed from the center of rotation of the first gear.
FIG. 7F illustrates the third embodiment, and is a schematic cross-sectional view in which a second opposing portion that opposes a second gear side face is viewed from the center of rotation of the second gear.

Next is a description of a driving apparatus 100*c* that is still another embodiment (third embodiment) of the invention and differs from the first embodiment shown in FIGS. 4A to 4G. FIGS. 7A to 7F illustrate the third embodiment. FIG. 7A is a schematic side view thereof. FIG. 7B is a schematic plan view thereof. FIG. 7C is a schematic cross-sectional view taken along line A1-A1 in FIG. 7A. FIG. 7D is a schematic cross-sectional view taken along line A2-A2 in FIG. 7A. FIG. 7E is a schematic cross-sectional view in which a first opposing portion 174*y* that opposes the first gear side face 130*a* is viewed from the center of rotation of a first gear 130*y*. FIG. 7F is a schematic cross-sectional view in which a second opposing portion 175*y* that opposes the second gear side face 140*a* is viewed from the center of rotation of a second gear 140*y*.

In the third embodiment, the first gear 130*y*, the second gear 140*y*, and a detection sensor 170*y* are provided instead of the first gear 130, the second gear 140, and the detection sensor 170 in the first embodiment.

The first detection information includes a first displacement information of a detection subject (here, a detected portion 172*y* according to the first cam unit 131 and the first opposing portion 174*y*) according to rotation of the first group photosensitive body 30*a* relative to the detection sensor 170*y*. The second detection information includes a second displacement information of a detection subject (here, a detected portion 172*y* according to the second cam unit 141 and the second opposing portion 175*y*) according to rotation of the second group photosensitive body 30*b* relative to the detection sensor 170*y*.

A configuration is adopted such that the first displacement information differs from the second displacement information. That is, the first displacement information is information that can be identified as being information of the first group photosensitive body 30*a* relative to the second displacement information, and the second displacement information is information that can be identified as being information of the second group photosensitive body 30*b* relative to the second displacement information. Thus, it is possible to easily identify the first detection information and the second detection information.

Specifically, with the detected face (an example of a detected position) 172*a* of the detected portion 172*y* as a reference, an actuator unit-side first relative distance d1 in the rotational axis line direction X from the detection face (an example of a first detection position) 174*a* of the first opposing portion 174*y*, and an actuator unit-side second relative distance d2 in the rotational axis line direction X from the detection face (an example of a second detection position) 175*a* of the second opposing portion 175*y*, differs. Here, the actuator unit-side second relative distance d2 is larger than the actuator unit-side first relative distance d1. Also, with the detected face 172*a* of the detected portion 172*y* as a reference, a detected portion-side first relative distance h1 (h1<d1) in the rotational axis line direction X from the first detection portion β1 of the first cam unit (here, a first convex portion) 131, and a detected portion-side second relative distance h2 (h2<d2) in the rotational axis line direction X from the second detection portion β2 of the second cam unit (here, a second convex portion) 141, are equal. Here, the first detection portion β1 is the position of the flat portion 131*c* of the first convex portion. Here, the second detection portion β2 is the position of the flat portion 141*c* of the second convex portion.

The sensor unit 173*y* is a displacement sensor that detects a detection distance d3 between the detection face (an example of a detection position) 173*c* and the detected face 172*a* of the detected portion 172*y*. For example, a non-contact-type sensor employing magnetism, light, or capacitance as a medium, or a contact-type sensor such as a dial gauge or a differential transformer, can be used as the displacement sensor.

Specifically, the first gear 130*y* and the second gear 140*y* are disposed such that the first gear side face 130*a* and the second gear side face 140*a* are positioned on the same plane. The height of the first cam unit 131 and the second cam unit 141 is the same. Thus, it is possible to share components between the first gear 130*y* and the second gear 140*y*, and thus, it becomes easier to match the rotational irregularity cycles of the respective group photosensitive bodies 30*a* and 30*b*, and component cost can be kept down.

That is, the first gear 130*y* and the second gear 140*y* are the same as the first gear 130 and the second gear 140 of the first embodiment, except that the first rotation angle θ1 of the arc-like detection region α1*x* of the first cam unit 131 is the same as the second rotation angle θ2 of the arc-like detection region α2*x* of the second cam unit 141. Also, the first opposing portion 174*y* and the second opposing portion 175*y* are the same as the first opposing portion 174 and the second opposing portion 175 of the first embodiment, except that the length of the first opposing portion 174*y* in the rotational axis line direction X is longer than that of the second opposing portion 175*y*.

The detected portion 172*y* is disposed such that the detected face 172*a* opposes the detection face 173*c* of the sensor unit 173*y*. Also, the notched guide portion 101*by* is formed in the cavity portion 101*a* so as to guide the detected portion 172*y* in the rotational axis line direction X.

In the third embodiment, a configuration may be adopted in which the detected portion-side first relative distance h1 differs from the detected portion-side second relative distance h2, and the actuator unit-side first relative distance d1 is equal to the actuator unit-side second relative distance d2.

Also, in the third embodiment, an example is given in which the detected face 172*a* of the detected portion 172*y* is used as a reference for the relative distance, but the detection face 173*c* of the sensor unit 173 may also be used as a reference for the relative distance.

Also, in the third embodiment, the first inner diameter r1 of the first opposing region α1 in the first gear side face 130*a* of the first gear 130*y* is the same as the second inner diameter r2 of the second opposing region α2 in the second gear side face of the second gear 140*y*, but the inner diameters r1 and r2 may also differ.

In the driving apparatus 100*c*, the first gear 130*y* and the second gear 140*y* rotate when detecting the displacement information of the detection subject according to rotation of the first and second group photosensitive bodies 30*a* and 30*b* relative to the detection sensor 170*y*.

In the first gear 130*y*, when the first cam unit 131 moves to the first opposing portion 174*y*, the first opposing portion 174*y* is pushed upward at one end of the first cam unit 131. Thus, the detected portion 172*y* also is pushed upward via the actuator unit 171, and so at the first detection position β1 of the first cam unit 131 (see FIG. 7E), the detection distance d3 changes from the initial distance to a predetermined first distance. When the first gear 130*y* further rotates, the first opposing portion 174*y* is lowered at the other end of the first cam unit 131. Thus, the detected portion 172*y* is also lowered via the actuator unit 171, and the detection distance d3 returns to the original initial distance.

Likewise, in the second gear 140*y*, when the second cam unit 141 moves to the second opposing portion 175*y*, the second opposing portion 175*y* is pushed upward at one end of the second cam unit 141. Thus, the detected portion 172*y* also is pushed upward via the actuator unit 171, and so at the second detection position β2 of the second cam unit 141 (see FIG. 7F), the detection distance d3 changes from the initial distance to a predetermined second distance that is shorter than the first distance. When the second gear 140*y* further rotates, the second opposing portion 175*y* is lowered at the other end of the second cam unit 141. Thus, the detected portion 172*y* is also lowered via the actuator unit 171, and the detection distance d3 returns to the original initial distance.

Thus, by rotation of the first gear 130*y* the detection distance d3 changes from the initial distance to the first distance, and by rotation of the second gear 140*y* the detection distance d3 changes from the initial distance to the second distance that is shorter than the first distance. Thus, it is possible to easily identify a difference between the first detection information and the second detection information.

(Rotation Phase Operation Control)

Next is a description of an example of operation for detecting the rotation phase Tr of the first group photosensitive body 30*a* and the second group photosensitive body 30*b* and adjusting the detected rotation phase Tr to a reference rotation phase, in the driving apparatuses 100*a* to 100*c* of the first, second, and third embodiments.

Figure 8:
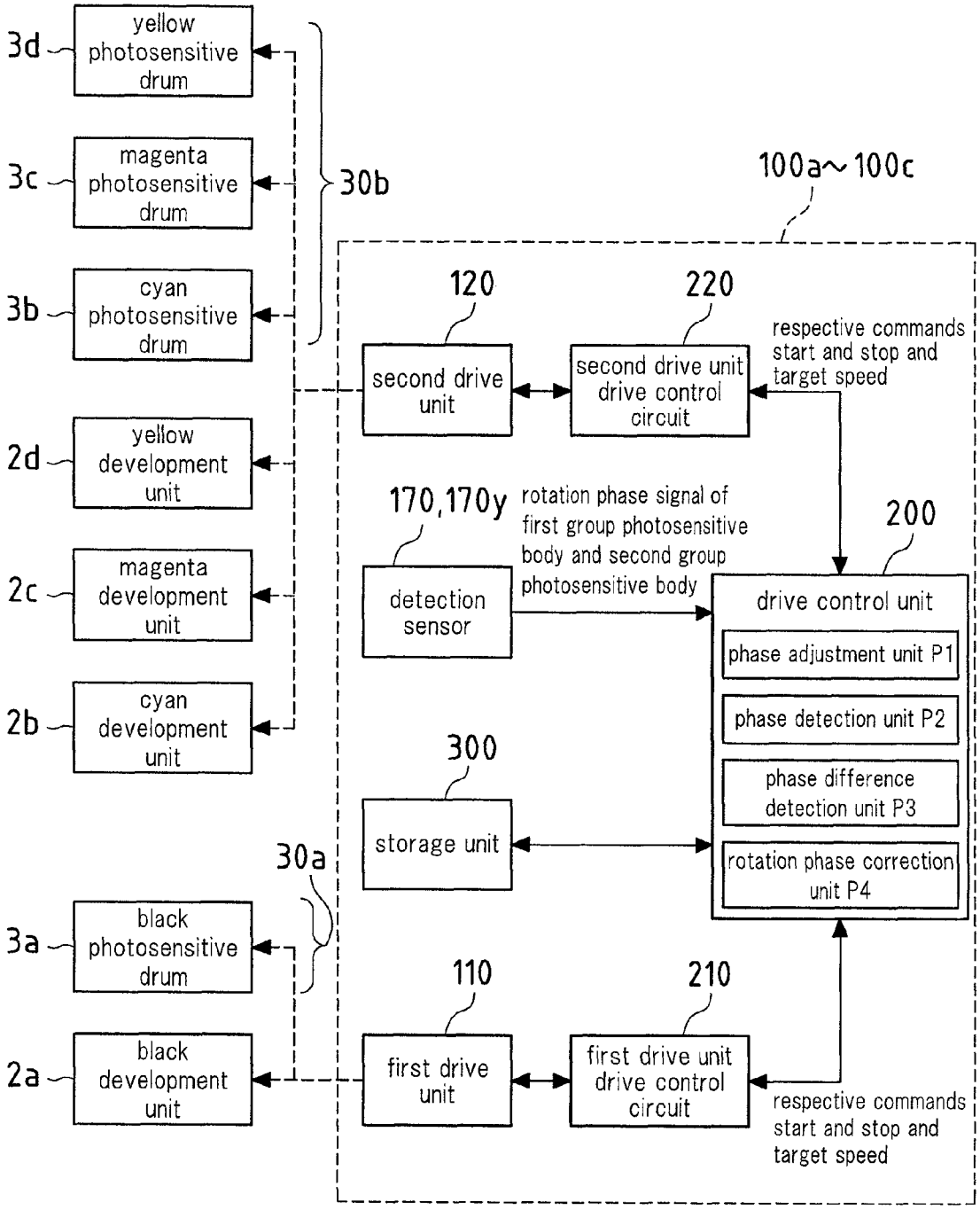
FIG. 8 is a control block diagram that shows a system configuration that allows operation of the driving apparatus of the first, second, and third embodiments.

FIG. 8 is a control block diagram that shows a system configuration that allows operation of the driving apparatuses 100*a* to 100*c* of the first, second, and third embodiments.

As shown in FIG. 8, the driving apparatuses 100*a* to 100*c* are further provided with a drive control unit 200 and a storage unit 300 that stores information from the drive control unit 200.

The detection sensors 170 and 170*y* are connected to an input system of the drive control unit 200. The first drive unit 110 and the second drive unit 120 are connected to an output system of the drive control unit 200.

As previously described, the first drive unit 110 is a motor that drives the black photosensitive body 3*a* of the first group photosensitive body 30*a*, and the black development unit 2*a*. The second drive unit 120 is a motor that drives the color photosensitive bodies 3*b*, 3*c*, and 3*d* of the second group photosensitive body 30*b*, and the color development units 2*b*, 2*c*, and 2*d*.

The drive control unit 200 is constituted from a microcomputer that includes a processing unit such as a CPU (Central Processing Unit), and a storage element that includes memories such as a ROM (Read Only Memory) and a RAM (Random Access Memory). More specifically, the drive control unit 200 performs drive control of various constituent elements by the processing unit loading into the RAM of the storage element and executing a control program stored in advance in the ROM of the storage element. The drive control unit 200 is instructed by a main control unit that controls overall image forming operation provided in the image forming apparatus D.

Specifically, the driving apparatuses 100*a* to 100*c* are further provided with a first drive unit drive control circuit 210 and a second drive unit drive control circuit 220.

The first drive unit drive control circuit 210 is connected between the drive control unit 200 and the first drive unit 110. The second drive unit drive control circuit 220 is connected between the drive control unit 200 and the second drive unit 120.

The drive control unit 200 gives commands to the first drive unit drive control circuit 210 to start and stop the first drive unit 110. The first drive unit drive control circuit 210 is a circuit that controls starting, stopping, and drive speed of the first drive unit 110 according to instructions from the drive control unit 200, and here, is a servo control circuit that performs control so as to match the drive speed of the first drive unit 110 to a target speed instructed by the drive control unit 200. The drive control unit 200 instructs the first drive unit drive control circuit 210 to drive the first drive unit 110 at a predetermined process speed (drive speed for image forming) when performing image forming.

Also, the drive control unit 200 gives commands to the second drive unit drive control circuit 220 to start and stop the second drive unit 120. The second drive unit drive control circuit 220 is a circuit that controls starting, stopping, and drive speed of the second drive unit 120 according to instructions from the drive control unit 200, and here, is a servo control circuit that performs control so as to match the drive speed of the second drive unit 120 to a target speed instructed by the drive control unit 200. The drive control unit 200 instructs the second drive unit drive control circuit 220 to drive the second drive unit 120 at the process speed when performing image forming.

The storage unit 300 stores a reference rotation phase described below, and here, is a non-volatile memory in which data can be rewritten.

The drive control unit 200, the storage unit 300, and the first and second drive unit drive control circuits 210 and 220 may be provided in the image forming apparatus D. Also, the storage unit 300 may be provided in the drive control unit 200.

Incidentally, in the first group photosensitive body 30*a* and the second group photosensitive body 30*b*, rotational irregularity may sometimes occur due to eccentricity of the photosensitive drums 3*a* to 3*d*, eccentricity of the drive transmission rotation members (for example, the first gears 130, 130*x*, and 130*y*, and the second gears 140, 140*x*, and 140*y*) that transmit rotational drive from the first drive unit 110 and the second drive unit 120 to the photosensitive drums 3*a* to 3*d*, and so forth. Therefore, rotational irregularity phase shift (color shift) caused by eccentricity or the like may sometimes occur between a black image formed by the first group photosensitive body 30*a* and a color image formed by the second group photosensitive body 30*b*.

Figure 9A:
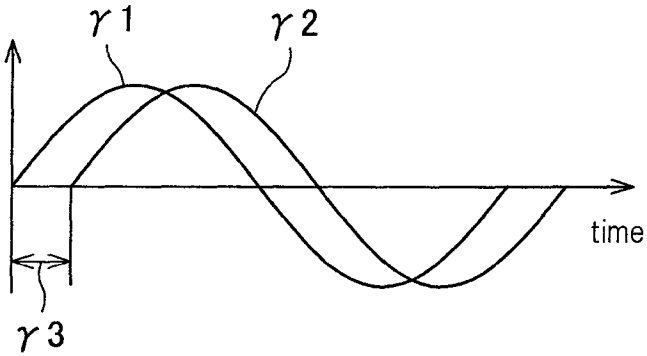
FIG. 9A illustrates rotational irregularity phase shift of a first group photosensitive body and a second group photosensitive body, and is a graph that shows a state in which a cycle indicating a displacement state of rotational irregularity occurring in the first group photosensitive body is shifted from a cycle indicating a displacement state of rotational irregularity occurring in the second group photosensitive body.
Figure 9B:
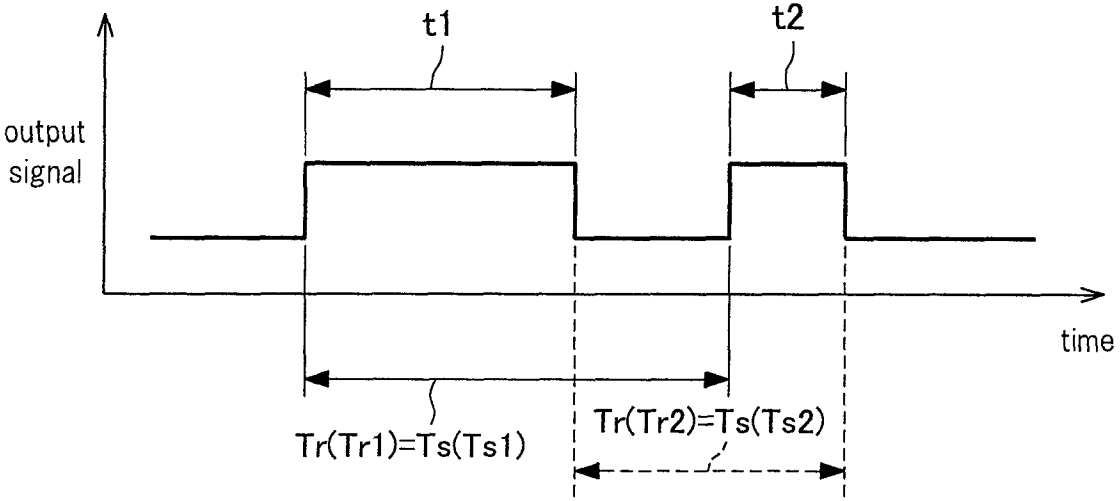
FIG. 9B illustrates rotational irregularity phase shift of the first group photosensitive body and the second group photosensitive body, and shows an output signal from a detection sensor when a rotation phase has been adjusted to a reference rotation phase.
Figure 9C:
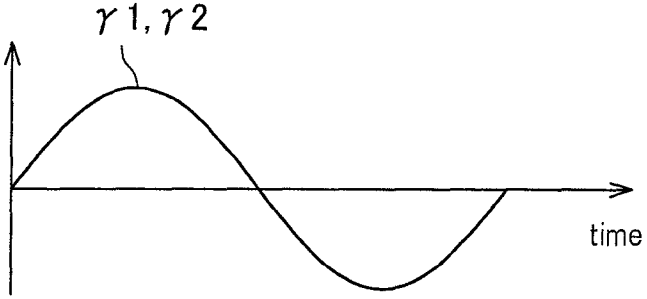
FIG. 9C illustrates rotational irregularity phase shift of the first group photosensitive body and the second group photosensitive body, and is a graph that shows a cycle when the rotation phase has been adjusted to the reference rotation phase.

FIGS. 9A to 9C illustrate rotational irregularity phase shift of the first group photosensitive body 30*a* and the second group photosensitive body 30*b*. FIG. 9A is a graph that shows a state in which a cycle γ1 indicating a displacement state of rotational irregularity occurring in the first group photosensitive body 30*a* is shifted from a cycle γ2 indicating a displacement state of rotational irregularity occurring in the second group photosensitive body 30*b*. FIG. 9B shows an output signal from a detection sensor when the rotation phase Tr has been adjusted to a reference rotation phase Ts. FIG. 9C is a graph that shows a cycle when the rotation phase Tr has been adjusted to the reference rotation phase Ts.

As shown in FIG. 9A, when a shift γ3 occurs between the cycle γ1 in the first group photosensitive body 30*a* and the cycle γ2 in the second group photosensitive body 30*b*, image shift (color shift) is likely to occur between a black image formed by the first group photosensitive body 30*a* and a color image formed by the second group photosensitive body 30*b*.

Therefore, the drive control unit 200 functions as a means that includes a phase adjustment unit P1, a phase detection unit P2, a phase difference detection unit P3, and a rotation phase correction unit P4.

As shown in FIG. 9B, in the phase adjustment unit P1, the rotation phase Tr (Tr1 or Tr2) of the first group photosensitive body 30*a* and the second group photosensitive body 30*b* is adjusted to the reference rotation phase Ts (Ts1 or Ts2) serving as a reference.

Thus, as shown in FIG. 9C, it is possible to adopt a configuration in which to the extent possible, a shift does not occur between the cycle γ1 in the first group photosensitive body 30*a* and the cycle γ2 in the second group photosensitive body 30*b*, and thus rotational irregularity caused by eccentricity or the like, and also image shift (color shift), can be suppressed.

Specifically, in the phase adjustment unit P1, a first phase adjustment (here, black adjustment) toner image is formed on the intermediate transfer belt 7 by the first group photosensitive body 30*a*, and a second phase adjustment (here, color adjustment) toner image is formed on the intermediate transfer belt 7 by the second group photosensitive body 30*b*, and based on these phase adjustment toner images, a reference rotation phase Ts (Ts1 or Ts2) that is an optimal rotation phase for the rotation phase Tr (Tr1 or Tr2) of the first group photosensitive body 30*a* and the second group photosensitive body 30*b* is obtained, and at least one among the first drive unit 110 and the second drive unit 120 is controlled so as to establish the obtained reference rotation phase Ts, thereby adjusting at least one of the rotation timing of the first group photosensitive body 30*a* and the rotation timing of the second group photosensitive body 30*b*.

The phase adjustment unit P1 can execute the above operation, for example, at the time of initial driving such as when power is turned on and/or at each instance of a predetermined period.

However, even when the rotation phase Tr of the first group photosensitive body 30*a* and the second group photosensitive body 30*b* is phase-matched to the reference rotation phase Ts, the rotation phase Tr may sometimes be shifted.

Figure 10B:
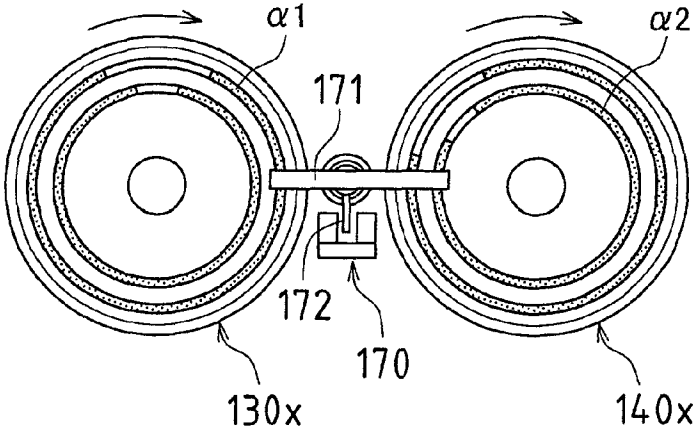
FIG. 10B illustrates rotation phase operation control, and shows a detection state thereof.
Figure 10A:
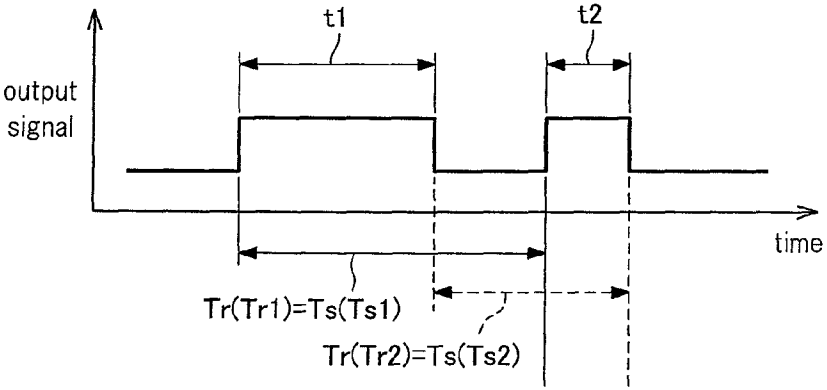
FIG. 10A illustrates rotation phase operation control, and shows an output signal from a detection sensor when a rotation phase has been adjusted to a reference rotation phase.
Figure 10D:
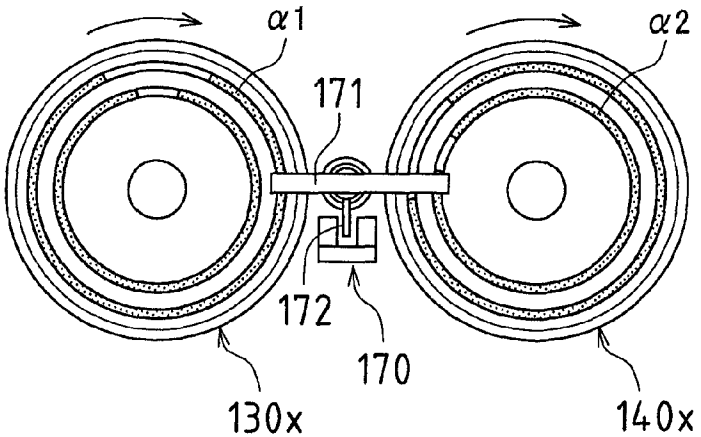
FIG. 10D illustrates rotation phase operation control, and shows a detection state thereof.
Figure 10C:
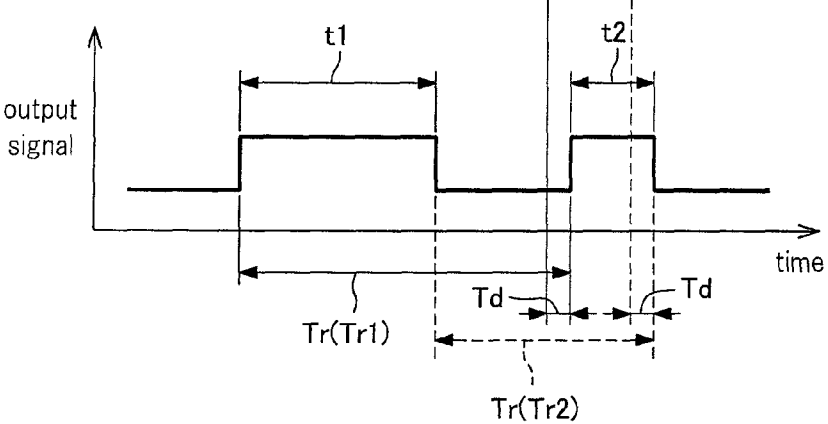
FIG. 10C illustrates rotation phase operation control, and shows an output signal from a detection sensor when a rotation phase is shifted from a reference rotation phase.

FIGS. 10A to 10D illustrate rotation phase operation control. FIG. 10A shows an output signal from the detection sensor 170 when the rotation phase Tr has been adjusted to the reference rotation phase Ts. FIG. 10B shows a detection state thereof. FIG. 10C shows an output signal from the detection sensor 170 when the rotation phase Tr is shifted from the reference rotation phase Ts. FIG. 10D shows a detection state thereof. FIGS. 10A to 10D show the configuration in the second embodiment.

As shown in FIGS. 10A and 10B, even when the rotation phase Tr of the first group photosensitive body 30*a* and the second group photosensitive body 30*b* is phase-matched to the reference rotation phase Ts, when forming an image by driving only any one among the first group photosensitive body 30*a* and the second group photosensitive body 30*b*, the rotation phase Tr (Tr1 or Tr2) of the first group photosensitive body 30*a* and the second group photosensitive body 30*b* may be completely different from the reference rotation phase Ts (Ts1 or Ts2). Alternatively, with a print operation, the rotation phase Tr (Tr1 or Tr2) of the first group photosensitive body 30*a* and the second group photosensitive body 30*b* may be shifted from the reference rotation phase Ts (Ts1 or Ts2) (see FIGS. 10C and 10D). Thus rotational irregularity image shift (color shift) caused by eccentricity or the like may sometimes occur.

Consequently, in the phase detection unit P2, the rotation phase Tr (Tr1 or Tr2) of the first group photosensitive body 30*a* and the second group photosensitive body 30*b* is detected based on the first detection time t1 and the second detection time t2 by the detection sensors 170 and 170*y*.

Below is a description regarding the case of the first embodiment shown in FIGS. 4A to 4G and the second embodiment shown in FIGS. 6A to 6D. The first and second embodiments differ from the third embodiment shown in FIGS. 7A to 7F only with regard to the identification subject for identifying a difference between the first detection information and the second information, so the below description is also applicable to the third embodiment, and therefore a description of the third embodiment is omitted here.

In the phase detection unit P2, when detecting the rotation phase Tr1 of the first group photosensitive body 30*a* and the second group photosensitive body 30*b*, detection is performed by calculating a phase time from the detection start st of the first detection time t1 of the first group photosensitive body 30*a* (here, start of an output signal from the detection sensor 170 due to sliding with the first cam unit 131 of the first opposing portion 174) until the detection start st of the second detection time t2 of the second group photosensitive body 30*b*

(here, start of an output signal from the detection sensor 170 due to sliding with the second cam unit 141 of the second opposing portion 175).

Also, when detecting the rotation phase Tr2 of the first group photosensitive body 30*a* and the second group photosensitive body 30*b*, detection is performed by calculating a phase time from the detection end ed of the first detection time t1 of the first group photosensitive body 30*a* (here, end of an output signal from the detection sensor 170 due to sliding with the first cam unit 131 of the first opposing portion 174) until the detection end ed of the second detection time t2 of the second group photosensitive body 30*b* (here, end of an output signal from the detection sensor 170 due to sliding with the second cam unit 141 of the second opposing portion 175).

Thus, it is possible to detect the rotation phase Tr (Tr1 or Tr2) of the first group photosensitive body 30*a* and the second group photosensitive body 30*b* with a comparatively simple control configuration.

The phase detection unit P2 preferably detects the rotation phase Tr during a print operation. Thus, it is not necessary to separately drive the first group photosensitive body 30*a* and the second group photosensitive body 30*b* in order to detect the rotation phase Tr, and to that extent it is possible to efficiently detect the rotation phase Tr.

Also, in the phase difference detection unit P3, detection is performed of a rotation phase difference (shift amount) Td (see FIG. 10C) of the rotation phase Tr (Tr1 or Tr2) detected by the phase detection unit P2, relative to the reference rotation phase Ts (Ts1 or Ts2) adjusted by the phase adjustment unit P1.

Specifically, the rotation phase difference (shift amount) Td is detected by calculating the difference between the reference rotation phase Ts adjusted by the phase adjustment unit P1 and the rotation phase Tr detected by the phase detection unit P2.

Also, in the rotation phase correction unit P4, based on the results of detection by the phase difference detection unit P3, the rotation phase Tr (Tr1 or Tr2) is corrected by changing at least one among the rotation timing of the first group photosensitive body 30*a* and the rotation timing of the second group photosensitive body 30*b* such that the rotation phase Tr (Tr1 or Tr2) of the first group photosensitive body 30*a* and the second group photosensitive body 30*b* matches the reference rotation phase Ts (Ts1 or Ts2).

Specifically, when determined from the difference between the reference rotation phase Ts and the rotation phase Tr that the rotation timing of the second gears 140 and 140*x* is earlier (or later) than the first gears 130 and 130*x*, at least one among the first drive unit 110 and the second drive unit 120 is controlled to delay (or accelerate) the rotation timing of the second gears 140 and 140*x* relative to the first gears 130 and 130*x* such that the reference rotation phase Ts and the rotation phase Tr are the same.

Thus, it is possible to match the rotation phase Tr (Tr1 or Tr2) of the first group photosensitive body 30*a* and the second group photosensitive body 30*b* to the reference rotation phase Ts (Ts1 or Ts2), and thus it is possible to reduce rotational irregularity image shift (color shift) caused by eccentricity or the like.

Incidentally, as in a case in which only any one among the first group photosensitive body 30*a* and the second group photosensitive body 30*b* is driven and so the rotation phase Tr of the first group photosensitive body 30*a* and the second group photosensitive body 30*b* is completely different from the reference rotation phase Ts, depending on the rotation phase Tr of the first group photosensitive body 30*a* and the second group photosensitive body 30*b*, for example, when the second detection time t2 is larger than the first detection time t1, in some instances all or part of the first detection time t1 may overlap the second detection time t2. Also, when the first detection time t1 is larger than the second detection time t2, in some instances all or part of the second detection time t2 may overlap the first detection time t1. Thus, the detection start st and the detection end ed by the detection sensor 170 only exist in one location.

Figure 11A:
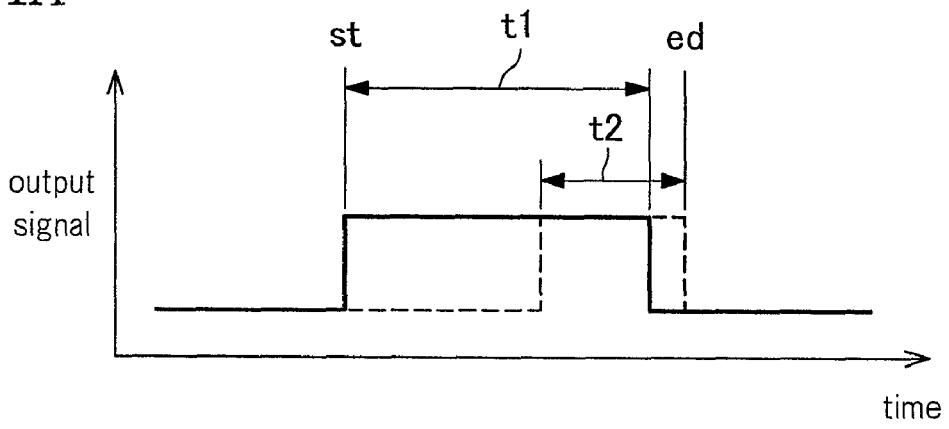
FIG. 11A shows an output signal for illustrating a state in which detection start and detection end by a detection sensor only exist in one location, and shows a state in which a first detection time and part of a second detection time are overlapping.
Figure 11B:
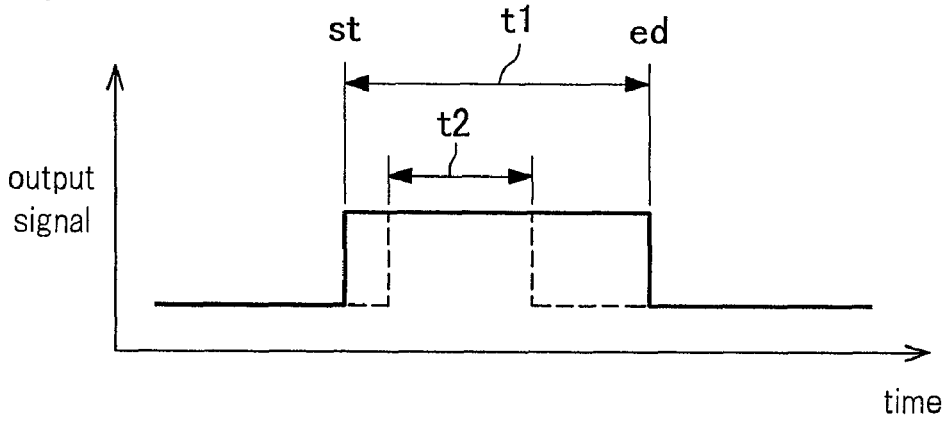
FIG. 11B shows an output signal for illustrating a state in which detection start and detection end by a detection sensor only exist in one location, and shows a state in which the first detection time and all of the second detection time are overlapping.

FIGS. 11A and 11B show an output signal for illustrating a state in which the detection start st and the detection end ed by the detection sensor 170 only exist in one location. FIG. 11A shows a state in which the first detection time t1 and part of the second detection time t2 are overlapping, and FIG. 11B shows a state in which the first detection time t1 and all of the second detection time t2 are overlapping. In FIGS. 11A and 11B, the first detection time t1 is indicated by a solid line, and the second detection time t2 is indicated by a broken line.

As shown in FIGS. 11A and 11B, the detection start st and the detection end ed by the detection sensor 170 exist in only one location.

In consideration of this point, in the phase detection unit P2, when determined that the detection start st by the detection sensor 170 only exists in one location, at least one among the first drive unit 110 and the second drive unit 120 is controlled to rotate at least one among the first group photosensitive body 30*a* and the second group photosensitive body 30*b* such that the detection start st by the detection sensor 170 exists in two locations, and then a phase time tr is measured, or, when determined that the detection end ed by the detection sensor 170 only exists in one location, at least one among the first drive unit 110 and the second drive unit 120 is controlled to rotate at least one among the first group photosensitive body 30*a* and the second group photosensitive body 30*b* such that the detection end ed by the detection sensor 170 exists in two locations, and then the phase time tr is measured. Thus, it is possible to reliably detect the rotation phase Tr (Tr1 or Tr2) of the first group photosensitive body 30*a* and the second group photosensitive body 30*b*.

Also, it is preferable that the reference rotation phase Ts (Ts1 or Ts2) adjusted by the phase adjustment unit P1 is stored in advance in the storage unit 300. In this case, the phase difference detection unit P3 detects a rotation phase difference of the rotation phase Tr (Tr1 or Tr2) detected by the phase detection unit P2, relative to the reference rotation phase Ts (Ts1 or Ts2) stored in the storage unit 300. Thus, for example, if the reference rotation phase Ts (Ts1 or Ts2) is adjusted by the phase adjustment unit P1 at the time of initial driving and/or at each instance of a predetermined period, and stored in the storage unit 300 when performing the adjustment, it is possible to eliminate a wasteful adjustment operation by the phase adjustment unit, and to that extent it is possible to shorten the operation control time.

Note that in the present embodiment, the first detection information and the second detection information are caused to differ from each other such that it is possible to identify a difference between the rotation timing of the first group photosensitive body 30*a* and the rotation timing of the second group photosensitive body 30*b* with the single detection sensors 170 and 170*y*, but a configuration may also be adopted in which the first detection information and the second detection information detected with the single detection sensors 170 and 170*y* are the same.

In this case, it is preferable that when changing the rotation phase Tr of at least one group photosensitive body among the first group photosensitive body 30*a* and the second group photosensitive body 30*b* (for example, when increasing or decreasing the speed of either group photosensitive body), after confirming whether or not the rotation phase Tr is separated from the reference rotation phase Ts, when the rotation phase Tr is separated from the reference rotation phase Ts, the change in the rotation phase Tr of at least one group photosensitive body is reversed (for example, when the speed of either group photosensitive body was increased, that speed is decreased, or when the speed of either group photosensitive body was decreased, that speed is increased).

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image forming apparatus that forms a plurality of images using a plurality of image carriers respectively corresponding to the images and stacks those images, the image forming apparatus comprising:

a first group to which at least one image carrier among the plurality of image carriers belongs;

a second group to which at least one image carrier among the remaining image carriers belongs; and a single detection sensor that detects a first detection information for identifying a rotation timing of the first group image carrier and also detects a second detection information for identifying a rotation timing of the second group image carrier, wherein the first detection information includes a first displacement information of a detection subject according to rotation of the first group image carrier relative to the detection sensor, and the second detection information includes a second displacement information of a detection subject according to rotation of the second group image carrier relative to the detection sensor.

2. The image forming apparatus according to claim 1, wherein the first detection information and the second detection information are caused to differ from each other, such that a difference between the rotation timing of the first group image carrier and the rotation timing of the second group image carrier can be identified with the single detection sensor.

3. The image forming apparatus according to claim 1, wherein the first detection information includes information of a first rotation angle of the first group image carrier, and the second detection information includes information of a second rotation angle of the second group image carrier.

4. The image forming apparatus according to claim 3, wherein the first rotation angle and the second rotation angle are caused to differ from each other, such that a difference between the rotation timing of the first group image carrier and the rotation timing of the second group image carrier can be identified.

5. The image forming apparatus according to claim 1, wherein the first group image carrier is for performing monochrome image forming, and the second group image carrier is for performing full-color image forming in collaboration with the first group image carrier.

6. An image forming apparatus that forms a plurality of images using a plurality of image carriers respectively corresponding to the images and stacks those images, the image forming apparatus comprising:

a first group to which at least one image carrier among the plurality of image carriers belongs;

a second group to which at least one image carrier among the remaining image carriers belongs;

a single detection sensor that detects a first detection information for identifying a rotation timing of the first group image carrier and also detects a second detection information for identifying a rotation timing of the second group image carrier;

a first drive unit for driving the first group image carrier;

a second drive unit for driving the second group image carrier;

a first rotation member that rotates according to rotation of the first group image carrier by the first drive unit; and a second rotation member that rotates according to rotation of the second group image carrier by the second drive unit;

wherein the detection sensor detects detection information of rotation timing of the first rotation member as the first detection information, and also detects detection information of rotation timing of the second rotation member as the second detection information.

7. The image forming apparatus according to claim 6, wherein:

the first rotation member includes a first gear that transmits drive from the first drive unit to the first group image carrier;

the second rotation member includes a second gear that transmits drive from the second drive unit to the second group image carrier, and whose rotational axis line is parallel to the first gear;

the detection sensor has an actuator unit capable of moving back-and-forth in the rotational axis line direction, a detected portion provided in the actuator unit, and a sensor unit that detects the detected portion;

a first opposing portion that opposes a side face of the first gear and a second opposing portion that opposes a side face of the second gear are provided in the actuator unit;

a first cam unit is provided in a portion in the circumferential direction of the first opposing region that opposes the first opposing portion of the side face of the first gear;

a second cam unit is provided in a portion in the circumferential direction of the second opposing region that opposes the second opposing portion of the side face of the second gear;

the first opposing portion and the first cam unit are formed such that the sensor unit detects the first detection information from back-and-forth movement of the detected portion according to back-and-forth movement in the rotational axis line direction of the actuator unit;

and the second opposing portion and the second cam unit are formed such that the sensor unit detects the second detection information from back-and-forth movement of the detected portion according to back-and-forth movement in the rotational axis line direction of the actuator unit.

8. The image forming apparatus according to claim 7, wherein a rotation angle of an arc-like detection region formed along the first opposing region of the first cam unit differs from a rotation angle of an arc-like detection region formed along the second opposing region of the second cam unit.

9. The image forming apparatus according to claim 8, wherein a first center angle of an arc-like detection region formed along the first opposing region opposing the first opposing portion in the actuator unit equals a second center angle of an arc-like detection region formed along the second opposing region opposing the second opposing portion in the actuator unit.

10. The image forming apparatus according to claim 8, wherein the sensor unit is a light sensor that is provided with a light-emitting portion and a light-receiving portion, and by blocking or allowing passage of incident light that is incident on the light-receiving portion from the light-emitting portion at the detected portion by back-and-forth movement of the detected portion according to back-and-forth movement of the actuator unit in the rotational axis line direction, detects the presence of the incident light at the light-receiving portion.

11. The image forming apparatus according to claim 7, wherein a first center angle of an arc-like detection region formed along the first opposing region opposing the first opposing portion in the actuator unit differs from a second center angle of an arc-like detection region formed along the second opposing region opposing the second opposing portion in the actuator unit.

12. The image forming apparatus according to claim 11, wherein a rotation angle of an arc-like detection region formed along the first opposing region of the first cam unit is the same as a rotation angle of an arc-like detection region formed along the second opposing region of the second cam unit.

13. The image forming apparatus according to claim 7, wherein using a detected position of the detected portion or a detection position of the sensor unit as a reference, a detected portion-side first relative distance in the rotational axis line direction from a first detection position of the first cam unit differs from a detected portion-side second relative distance in the rotational axis line direction from a second detection position of the second cam unit.

14. The image forming apparatus according to claim 13, wherein using the detected position of the detected portion or the detection position of the sensor unit as a reference, an actuator unit-side first relative distance in the rotational axis line direction from a first detection position of the first opposing portion equals an actuator unit-side second relative distance in the rotational axis line direction from a second detection position of the second opposing portion.

15. The image forming apparatus according to claim 13, wherein the sensor unit is a displacement sensor that detects the distance to the detected position of the detected portion.

16. The image forming apparatus according to claim 7, wherein using a detected position of the detected portion or a detection position of the sensor unit as a reference, an actuator unit-side first relative distance in the rotational axis line direction from a first detection position of the first opposing portion differs from an actuator unit-side second relative distance in the rotational axis line direction from a second detection position of the second opposing portion.

17. The image forming apparatus according to claim 16, wherein using the detected position of the detected portion or the detection position of the sensor unit as a reference, a detected portion-side first relative distance in the rotational axis line direction from a first detection position of the first cam unit equals a detected portion-side second relative distance in the rotational axis line direction from a second detection position of the second cam unit.

18. The image forming apparatus according to claim 7, wherein the size of the first opposing region in the side face of the first gear is the same as the size of the second opposing region in the side face of the second gear.

19. The image forming apparatus according to claim 7, wherein the size of the first opposing region in the side face of the first gear differs from the size of the second opposing region in the side face of the second gear.

20. The image forming apparatus according to claim 19, wherein in the first gear, in addition to the first cam unit, the second cam unit provided in the second gear is provided when the first gear serves as the second gear, and in the second gear, in addition to the second cam unit, the first cam unit provided in the first gear is provided when the second gear serves as the first gear.

21. The image forming apparatus according to claim 7, wherein the first cam unit and the second cam unit have an ascending slope portion and a descending slope portion.

22. The image forming apparatus according to claim 21, wherein between the ascending slope portion and the descending slope portion is a flat portion that is orthogonal to the rotational axis line direction.

23. The image forming apparatus according to claim 7, wherein among both ends along the first opposing region in the first opposing portion, a corner of at least one end has the form of a curved face, and among both ends along the second opposing region in the second opposing portion, a corner of at least one end has the form of a curved face.

24. The image forming apparatus according to claim 7, wherein the first opposing portion and the second opposing portion have an ascending slope portion and a descending slope portion.

25. The image forming apparatus according to claim 7, wherein the first cam unit is formed in a rib provided in a side face of the first gear, and the second cam unit is formed in a rib provided in a side face of the second gear.

26. The image forming apparatus according to claim 7, comprising an energizing member that energizes the actuator unit toward the first gear and the second gear.

27. An image forming apparatus that forms a plurality of images using a plurality of image carriers respectively corresponding to the images and stacks those images, the image forming apparatus comprising:

a first group to which at least one image carrier among the plurality of image carriers belongs;

a second group to which at least one image carrier among the remaining image carriers belongs;

a single detection sensor that detects a first detection information for identifying a rotation timing of the first group image carrier and also detects a second detection information for identifying a rotation timing of the second group image carrier;

a phase adjustment unit that adjusts a rotation phase of the first group image carrier and the second group image carrier to a reference rotation phase serving as a reference;

a phase detection unit that detects the rotation phase of the first group image carrier and the second group image carrier based on the first detection information and the second detection information by the detection sensor;

a phase difference detection unit that detects a rotation phase difference of the rotation phase detected by the phase detection unit relative to the reference rotation phase adjusted by the phase adjustment unit; and a rotation phase correction unit that, based on the detection result by the phase difference detection unit, changes at least one among the rotation timing of the first group image carrier and the rotation timing of the second group image carrier to correct the rotation phase of the first group image carrier and the second group image carrier.

28. The image forming apparatus according to claim 27, wherein the phase detection unit measures a phase time between detection start of the first detection information by the detection sensor and detection start of the second detection information by the detection sensor, or measures a phase time between detection end of the first detection information by the detection sensor and detection end of the second detection information by the detection sensor.

29. The image forming apparatus according to claim 28, wherein in the phase detection unit, when the detection start by the detection sensor only exists in one location, at least one among the first group image carrier and the second group image carrier is rotated such that the detection start by the detection sensor exists in two locations, and then the phase time is measured, or, when the detection end by the detection sensor only exists in one location, at least one among the first group image carrier and the second group image carrier is rotated such that the detection end by the detection sensor exists in two locations, and then the phase time is measured.

30. The image forming apparatus according to claim 27, wherein the reference rotation phase adjusted by the phase adjustment unit is stored in advance in the storage unit, and the phase difference detection unit detects a rotation phase difference of the rotation phase detected by the phase detection unit, relative to the reference rotation phase stored in the storage unit.

31. The image forming apparatus according to claim 27, wherein the phase detection unit detects the rotation phase during a print operation.

* * * * *